US006553191B1

(12) United States Patent
Nakane

(10) Patent No.: US 6,553,191 B1
(45) Date of Patent: Apr. 22, 2003

(54) ADJUSTMENT-CONTROL SYSTEM FOR IMAGE FORMING APPARATUS

(75) Inventor: Rintaro Nakane, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/659,556

(22) Filed: Sep. 11, 2000

(51) Int. Cl.[7] ..... G03G 15/00

(52) U.S. Cl. ..... 399/38; 399/46; 399/49; 399/72

(58) Field of Search ..... 399/38, 46, 49, 399/50, 51, 53, 72

(56) References Cited

U.S. PATENT DOCUMENTS 6,185,385 B1 * 2/2001 Mestha et al. ..... 399/49
6,483,997 B1 * 11/2002 Nakazato ..... 399/46

FOREIGN PATENT DOCUMENTS

| | | |
|---|---|---|
| JP | 11-38737 | 2/1999 |
| JP | 11-258873 | 9/1999 |
| JP | 2000-89525 | 3/2000 |

* cited by examiner

*Primary Examiner*—Hoang Ngo
(74) *Attorney, Agent, or Firm*—Foley & Lardner

(57) ABSTRACT

An adjustment control system compares multiple control amounts detected by a sensor with target values, thereby computing individual control amount deviations. When at least one of the control amount deviations is out of a predetermined tolerance, an operation-amount-determining section determines operation amounts for compensating the control amount deviations. When successful instances that have been used in the computed control amount deviations are available, the operation-amount-determining section executes a learning-control method that determines the operation amounts according to the control instances. When the successful instances are not available, the operation-amount-determining section executes an adaptive-control method and thereby determines the operation amounts. As a result of the execution of the learning-control, when the control amount deviations are not converged into the tolerance, the operation-amount-determining section determines the successful instances used in the control to be inappropriate. Then, the operation-amount-determining section switches from the learning-control to the adaptive-control, thereby executing adjustment control. In this case, inappropriate successful instances are deleted.

16 Claims, 18 Drawing Sheets

| CONTROL AMOUNT | DEFINITION |
|---|---|
| e1 | ΔQH (=QH−QHT) : HIGH-DENSITY-AREA DEVIATION |
| e2 | ΔQL (=QL−QLT) : LOW-DENSITY-AREA DEVIATION |

| OPERATION AMOUNT | DEFINITION |
|---|---|
| a1 | ΔVC CONTRAST-VOLTAGE-MODIFICATION AMOUNT |
| a2 | ΔVBG BACKGROUND-VOLTAGE-MODIFICATION VOLTAGE |

| O/G | a1 | a2 |
|---|---|---|
| e1 | O | G |
| e2 | ○ | × |
| | ○ | ○ |

ADJUSTMENT-CONTROL SYSTEM FOR IMAGE FORMING APPARATUS

BACKGROUND OF THE INVENTION

The present invention relates to an adjustment control system in an adjustment mechanism for maintaining the quality of images produced by an image forming apparatus, such as an analog copying machine, a digital copying machine, a facsimile machine, and a laser printer.

An image forming apparatus, for example, an analog copying machine comprises an optical unit and a process unit. The optical unit reads an image on a document placed on a document table formed of glass. The process unit forms a developer image according to the image read out by the optical unit and transfers the image onto a recording medium such as a sheet paper.

In the copying machine, a resolution that can finally been obtained for a photocopy image depends on a resolution of exposure on a photoconductive drum and faithful-reproductivity of electrophotography processing for the exposure image.

For example, in an image forming apparatus, there occurs a case where photocopied objects produced by the same copying machine from the same original sheet material have densities differing from each other. The image density of an electrophotograph varies depending upon influence of variation and deterioration in image-forming conditions according to environmental and aging factors. Needless to say for analog copying machines, but also for other multigradation printers and digital copying machines, it is important to minimize the variation in the image density and to thereby stabilize the image density so that the quality of images can be maintained. Particularly, for color images, the image density influences not only density-reproductivity, but also color-reproductivity, therefore, it can be the that the stabilization in the image density is an indispensable conditional requirement.

Under these circumstances, conventional methods perform feedback control. The feedback control allows multiple test patterns to be formed on an image-carrier, detects the densities of the images, thereby grasps the variation in gradation characteristics, and repeats adjustment of operation sections in an image-forming section and determination for the quality (goodness or badness). In the control, the amounts of operations corresponding to control amount deviations are computed according to lookup tables preliminary created. The contents of the lookup tables are created offline. To describe the tables, a variety of experiments must be carried out to grasp characteristics (amounts of operations-corresponding to control amounts) of adjustment objects. The creation therefore requires much manpower and time.

In multi-input and multi-output systems, generally, the individual dependence relationships between inputs and outputs are not independent of each other. Therefore, description of the input-output relation-ships into the lookup tables requires lookup tables corresponding to the number of dimensions of the number of the inputs and the outputs. A system that handles a large number of dimensions therefore requires a large memory capacity for storing the tables; and accordingly, it requires a very large number of identification tasks All to be performed therefor. In addition, there are cases the aforementioned relationships are not suitable to an intended apparatus because of nonlinear characteristics, difference between the produces, reproductivity, and aged deteriorations. The employment of the feedback control allows the method to be practicable even in a case where the identification is incomplete to a certain extent. In this case, however, the number of converging operations and control time, before acceptance conditions of the quality determination is satisfied, is resultantly increased by the deviations from the characteristics of the apparatus that has processed the identification tasks.

As described above, in most cases where the multiple adjustment portions exist, adjustment portions have the dependence relationship with each other. This causes a phenomenon such as that, when one adjustment portion is adjusted in consideration of one adjustment amount, other multiple adjustment amounts are caused to vary; and when another adjustment portion is then operated for compensation therefor, a different characteristics amount is caused to vary. Thus, the method still arises problems in that the optimum adjustment is difficult and the efficiency of adjustment significantly decreases.

Jpn. Pat. Appln. KOKAI Publication No. 11-258873 discloses an adjustment control system that employs a rule-generating method, a feedback control method, and an adjustment control system. The rule-generating method generates desired adjusting rules according to the aforementioned various dependence relationships. The feedback control method repeats detection, determination, and scanning until a control amount deviation is adjusted to be within a given tolerance. This system combines the rule-generating method and the feedback control method, thereby successively detects the sensitivity, and further uses the adaptive-control method that determines the adjusting operation amount according to a result of the aforementioned checking for the density.

Adjustment-control systems as described above are required to implement reduction in the number of the control operations required for adjustment convergence and to implement further reduction in control time. For example, in an image forming apparatus, in a case where the density of a test pattern is measured, and the measurement is used as a control amount, developer consumption and apparatus-unusable time are required to be reduced as much as possible; and also, time required for the adjustment operation at an actual control site is required to be reduced as much as possible.

To comply with these requirements, Jpn. Pat. Appln. KOAKI Publication No. 2000-089525 proposes an adjustment control system that employs a so-called learning-control method and the above-described adaptive-control method. The learning-control method stores the relationships between individual control amounts and the operation amounts as successfully experienced instances so as to be used in subsequent control operations. The proposed system selectively executes the learning-control method and the adaptive-control method, and thereby, determines the operation amount. In addition, the proposed adjustment control system does not require the development of the lookup tables as described above, thereby allowing implementation of reduction of manpower, securement of adjustment convergence, and improvement in convergence efficiency.

However, the described adjustment control system, which selectively executes the adaptive-control method and the learning-control method, causes cases where the convergence is difficult, and defects such as overshoot occur when the system stores inappropriate learning data because of aged deteriorations and an abnormal state of the adjustment-object system. These defects repeatedly occur in subsequent adjusting operations.

BRIEF SUMMARY OF THE INVENTION

The present invention has been contrived in consideration of the above circumstances and its object is to provide an adjustment control system which prevents occurrence of problems making convergence and the like in control operations to be difficult and which can efficiently perform an optimum adjustment.

To achieve the above, an adjustment control system for an image forming apparatus comprises detecting means for detecting individual control amounts; deviation computing means for computing a plurality of control amount deviations in accordance with the control amounts detected by the detecting means and a predetermined target value; deciding means for deciding whether or not the individual control amount deviations are within a predetermined tolerance; operation amount determining means for determining an operation amount for compensating each of the plurality of control amount deviations when at least one of the control amount deviations is determined by the detecting means to be out of the predetermined tolerance; a plurality of operating means for compensating the control amounts by performing operation by the determined operation amount; and a processing step control section for executing adjustment control that repeats the detection of the control amounts, the decision, the determination of the operation amounts, and the operation of the operating means until the control amount deviations computed are converged into the predetermined tolerance.

The operation amount determining means comprises an adaptive control section for executing adaptive control, which comprises operation selecting means for selecting the operating means for adjusting objective control amount deviations that are out of the predetermined tolerance according to a preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations; first storing means for storing control amount deviations and the operation amounts corresponding thereto on a basis of the detection and operation in a period when adjustment of the objective control amount deviations is started and the objective control amount deviations are adjusted to be within the tolerance; second storing means for computing the sum of the operation amounts which correspond to the control amounts in each compensation operation and stored in the first storing means and for storing the sum of the operation amounts as learning data when all the control amount deviations are adjusted to be within the tolerance; a learning control section comprising second operation amount computing means for determining the operation amount for the operating means according to the learning data stored in the second storing means and for executing a learning control method; determining means for determining whether or not learning data corresponding to the control amount deviations is stored in the second storing means; first control-method selecting means for determining the operation amount by selecting the adaptive control section when no corresponding learning data is determined by the determining means to exist and for determining the operation amount by selecting the learning control section when corresponding learning data is determined by the determining means to exist; and switching means for switching to adaptive control by the adaptive control section when a control amount deviation identical to the control amount deviation stored in the first storing means is computed by the deviation computing means during the execution of the learning control by the learning control section.

According to another aspect of the present invention, an adjustment control system for an image forming apparatus comprises detecting means for detecting individual control amounts; deviation computing means for computing a plurality of control amount deviations according to the control amounts detected by the detecting means and a predetermined target value; deciding means for deciding whether or not the individual control amount deviations are within a predetermined tolerance; operation amount determining means for determining an operation amount for compensating each of the plurality of control amount deviations when at least one of the control amount deviations is determined by the deciding means to be out of the predetermined tolerance; a plurality of operating means for compensating for the control amounts by performing operation by the operation amount determined; and a processing step controlling section for executing adjustment control that repeats the detection of the control amounts, the decision, the determination of the operation amounts, and the operation of the operating means until the control amount deviations computed are converged into the predetermined tolerance.

The operation amount determining means comprises an adaptive control section for executing adaptive control, which comprises operation selecting means for selecting the operating means for adjusting objective control amount deviations that are out of the predetermined tolerance according to a preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations; first storing means for storing control amount deviations and the operation amounts corresponding thereto on a basis of the detection and operation in a period when adjustment of the objective control amount deviations is started and the objective control amount deviations are adjusted to be within the tolerance; second storing means for computing the sum of the operation amounts which correspond to the control amounts in each compensation operation and stored in the first storing means and for storing the sum of the operation amounts as learning data when all the control amount deviations are adjusted to be within the tolerance; a learning control section comprising second operation amount computing means for determining the operation amount for the operating means according to the learning data stored in the second storing means and for executing a learning control method; determining means for determining whether or not learning data corresponding to the control amount deviations is stored in the second storing means; first control-method selecting means for determining the operation amount by selecting the adaptive control section when no corresponding learning data is determined by the determining means to exist and for determining the operation amount by selecting the learning control section when corresponding learning data is determined by the determining means to exist; and switching means for switching to the adaptive control by the adaptive control section when a control amount deviation is not converged into the predetermined tolerance as a result of the execution of the learning control by the learning control section.

In the above aspect of the invention, the adjustment control system comprise learning-data deleting means for deleting learning data used in the learning control when the learning control is switched by the switching means to the adaptive control by the adaptive control section.

Furthermore, according to the adjustment control system of the present invention, the operation amount determining means comprises an adaptive control section for executing adaptive control, which comprises operation selecting means for selecting the operating means for adjusting objective control amount deviations that are out of the predetermined tolerance according to preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations; first storing means for storing control amount deviations and the operation amounts corresponding thereto on a basis of the detection and operation in a period when adjustment of the objective control amount deviations is started and the objective control amount deviations are adjusted to be within the tolerance; second storing means for computing the sum of the operation amounts which correspond to the control amounts in each compensation operation and stored in the first storing means and for storing the sum of the operation amounts as learning data when all the control amount deviations are adjusted to be within the tolerance; a learning control section comprising second operation amount computing means for determining the operation amount for the operating means according to the learning data stored in the second storing means and for executing a learning control method; determining means for determining whether or not learning data corresponding to the control amount deviations is stored in the second storing means; a control method selecting means for determining the operation amount by selecting the adaptive control section when no corresponding learning data is determined by the determining means to exist and for determining the operation amount by selecting the learning control section when corresponding learning data is determined by the determining means to exist; and learning-data deleting means for deleting learning data used in the learning control when the control amount deviations satisfy predetermined adjustment control completion conditions before the control amount deviations are converged into the predetermined tolerance as a result of execution of the learning control by the learning control section, the adjustment control completion conditions including a conditional case where the operation amount is out of a predetermined limit value and a conditional case where the number of operations of the operating means in the adjustment control reaches a predetermined maximum number of control operations.

In the above aspect of the invention, the adjustment control system may also comprise an initial condition setting means for setting initial conditions and also for clearing the data stored in the method selection storing means when the adjustment control is started, and a retry means for allowing the initial condition setting means to clear data representing the initial conditions and the data in the method selection storing means and for allowing the adaptive control section to re-execute the adaptive control.

According to the adjustment control system configured as described above for use for the image forming apparatus, a control system can be configured such that the manpower for designing the controlling unit is reduced, and in addition, requirements for the difference between produces and long-term aged deteriorations of the control objects can be autonomously satisfied. Also, in an inexperienced state, the control methods such as the adaptive-control method that ensures the convergence quality and the learning-control method can be combined with each other. According to the combination, the sensitivity is checked successively or with appropriate timing, the operation amounts are thereby determined, cases where the convergence operations are completed are learned as successfully experienced instances. In a case similar to the previous operations, the knowledge obtained by the learning can be used; therefore, the number of converging operations can be reduced. In execution of the learning-control method, when the convergence for control amount deviations is difficult or when overshoot is caused, the method can be switched to the adaptive-control method, thereby allowing the quality of the convergence in the control to be assured. Also, deletion of unnecessary learning data prevents recurrence of defects such as overshoot, thereby allowing reliability to be improved.

Additional objects and advantages of the invention will be set forth in the description which follows, and in part will be obvious from the description, or may be learned by practice of the invention. The objects and invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principle of the invention.

DETAILED DESCRIPTION OF THE INVENTION

Hereinbelow, referring to the accompanying drawings, a detailed description will be given of a color laser printer comprising an adjusting system according to an embodiment of the present invention.

Figure 1:
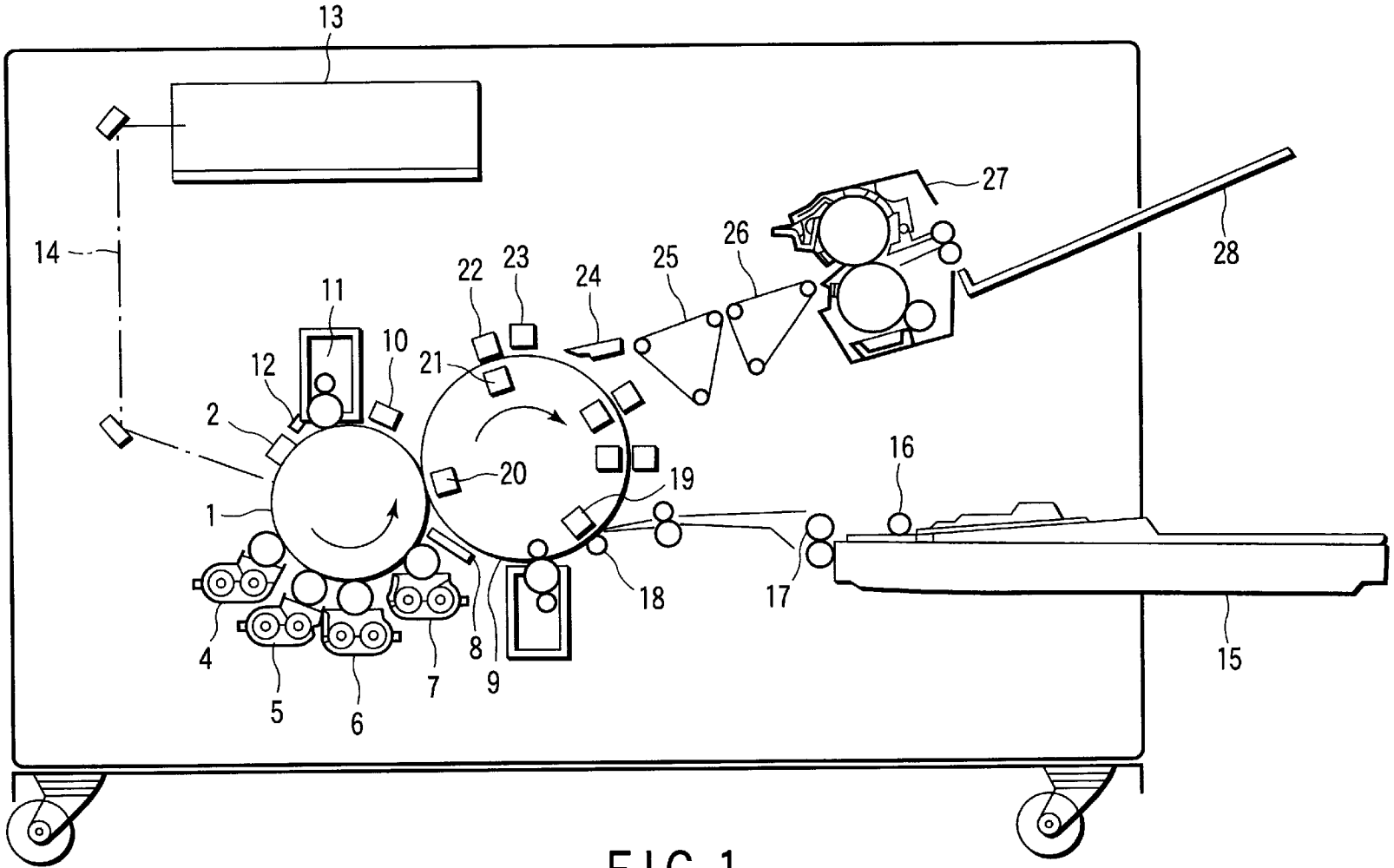
FIG. 1 is a cross-sectional view schematically showing a color laser printer according to an embodiment of the present invention.

As shown in FIG. 1, the color laser printer comprises a photoconductive drum 1 (image carrier) arranged to be rotatable counterclockwise as viewed in the figure. Around the photoconductive drum 1, there are provided a charging unit 2 serving as charging means; a first developer unit 4, a second developer unit 5, a third developer unit 6, a fourth developer unit 7 which serve as developing means; a toner-adhesion-amount measuring device 8; a transfer drum 9 serving as a transfer material supporting unit; a pre-discharge unit 10; a cleaning unit 11; and a discharge lump 12.

The surface of the photoconductive drum 1 is uniformly charged by the charging unit 2. A laser beam 14 emitted from a laser exposing unit 13 (exposing means) exposes the surface of the photoconductive drum 1 between the charging unit 2 and the first developer unit 4, thereby forming an electrostatic latent image corresponding to image data.

The first to fourth developer units 4 to 7 individually develop the electrostatic latent image formed on the photoconductive drum 1, which correspond to individual colors, in order to form toner images of individual colors. For example, the first developer unit 4 develops magenta images, the second developer unit 5 develops cyan images, the third developer unit 6 develops yellow images, and the fourth developer unit 7 develops black images.

A transfer sheet paper as the transfer material is fed by a paper-feeding roller 16 from a paper-feeding cassette 15, is adjusted by a resist roller 17 for its position, is then fed by the resist roller 17 so as to be attracted to a predetermined position of the transfer drum 9, and is then electrostatically attracted by means of an attracting roller 18 and an attracting charging unit 19 to the predetermined potion of the transfer drum 9. The sheet paper is then fed in the state of being attracted onto the transfer drum 9 according to the clockwise rotation of the drum 9.

A toner image developed on the photoconductive drum 1 is transferred, by a transfer charger 20, onto a sheet paper in the position where the photoconductive drum 1 and the transfer drum 9 oppose each other. For color printing, a step of one cycle per rotation of the transfer drum 9 is performed multiple times with the developer unit being switched, and toner images of different colors are multiply transferred on the transcription sheet paper.

The sheet paper onto which the toner images have been transferred is further fed according to the rotation of the transfer drum 9, and are electrically discharged by a pre-separation inner discharging unit 21, a pre-separation outer discharging 22, and a separation discharging unit 23. Then, the sheet paper is peeled from the transfer drum 9 by a separating claw 24 and is further fed by carrier belts 25 and 26 to a fixing unit 27. Toner on the sheet paper is heated by the fixing unit 27 and is thereby caused to melt. Then, the toner fixes onto the sheet paper immediately after the sheet paper is fed out of the fixing unit 27. Thereafter, the sheet paper is fed out onto a tray 28.

Figure 2:
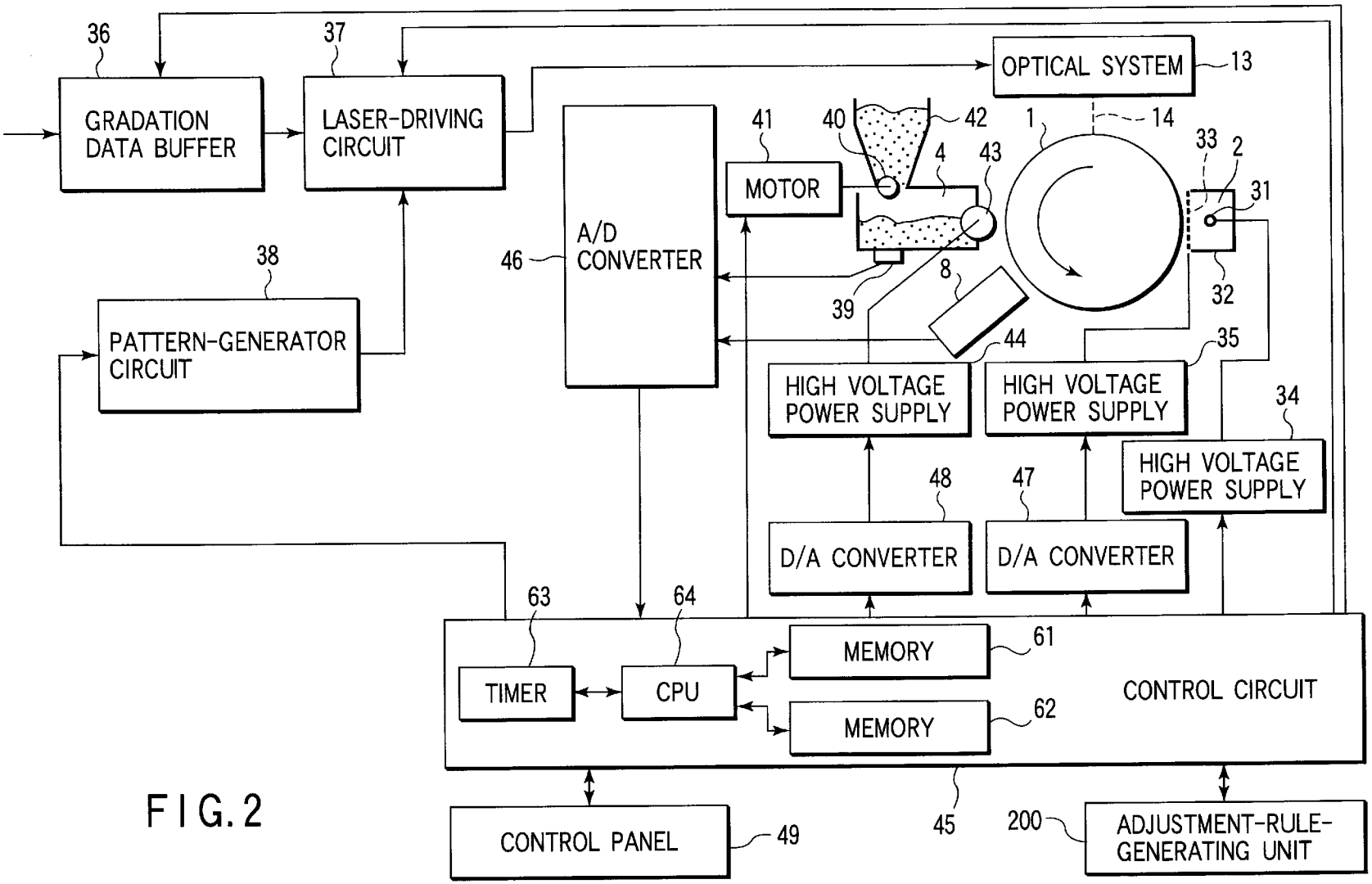
FIG. 2 is a schematic view showing charging sections, exposure sections, developing sections, and a control system therefor in the color laser printer.

As shown in FIG. 2, in the color laser printer, the charging unit 2 is mainly configured of a charge wire 31, a conductive casing 32, and a grid electrode 33. The charge wire 31 is connected to a corona high voltage power supply and performs corona-discharging for the surface of the photoconductive drum 1 so as to charge it. The grid electrode 33 is connected to a grid-bias high voltage power supply and controls the amount of charge onto the surface of the photoconductive drum 1 in accordance with the grid-bias voltage.

The surface of the photoconductive drum 1, which has been uniformly charged, is exposed to the modulated laser beam 14 emitted from the laser exposing unit 13.

This allows an electrostatic latent image to be formed. A gradation data buffer 36 stores gradation data received from a controller or an external apparatus (not shown), compensates gradation characteristics of the printer, and converts the gradation data into a laser exposure time (pulse width) data.

A laser driving circuit 37 modulates a laser-driving current (emission time) according to the laser-exposure-time data applied from the gradation data buffer 36, in synchronization with a scanning position of the photoconductive drum 14. A semiconductor laser oscillator (not shown) arranged in the laser exposing unit 13 is driven by the modulated laser-driving current and performs emitting operation in accordance with the exposure time data.

Moreover, the laser driving circuit 37 compares an output of a monitoring photoreceptor element (not shown) provided in the laser exposing unit 13 with a preset value; then, by using the driving current, controls the amount of output light of the semiconductor laser oscillator so as to maintain the preset value.

A pattern generator circuit 38 generates two gradation data items for two test patterns. One of the test patterns has a low density, whereas the other one has a low density. These test patterns thus having the densities differing from each other are used toner-adhesion-amount measurement. Then, the pattern generator circuit 38 sends the generated gradation data to the laser driving circuit 37. In this case, the test patterns may be stored in a memory 61 (described later). In the test patterns corresponding to the two gradation data items, the one having the high density is referred to as a high-density test pattern, and the other one having the low density is referred to as a low-density test pattern.

The electrostatic latent image formed on the surface of the photoconductive drum 1 is developed by the developer unit 4. The developer unit 4 is, for example, of two-components development, and contains developer made of toner and carrier. The weight ratio of toner in the developer (which is referred to as toner density, hereinbelow) is measured by a toner-density-measuring section 39. A toner-supply motor 41 for driving a toner-supply roller 40 is controlled in accordance with an output of the toner-density-measuring section 39, thereby supplying toner stored in a toner hopper 42 to the developer unit 4.

A development roller 43 is formed of a conductive material and connected to a high voltage power supply for application of a developing bias voltage. The development roller 43 rotates in a state where the developing bias voltage is applied, and allows the toner to adhere onto an electrostatic latent image formed on the photoconductive drum 1, thereby developing the image. A toner image thus developed on the photoconductive drum 1 is then transferred by the transfer drum 9 onto the sheet paper.

Figure 3:
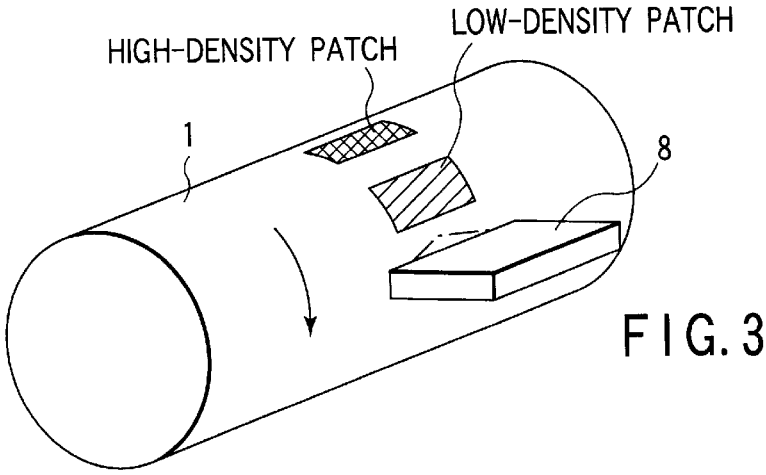
FIG. 3 is a perspective view showing a photoconductive drum on which there are developed a high-density area that corresponds to high-density gradation data and low-density area that corresponds to low-density gradation data, and a toner-adhesion-amount measuring device.

A control circuit 45 controls the pattern generator circuit 38 to generate gradation data at completion of warm-up processing performed after the power is turned on, and allows the high and low gradation patterns for toner-adhesion-amount measurement, to be exposed on the photoconductive drum 1. Then, the high and low gradation patterns are individually developed so that a test pattern area corresponding to the high-density gradation data (high-density patch: high-density area) and a test pattern area corresponding to the low-density gradation data (low-density patch: low-density area) are individually formed, as shown in FIG. 3.

When these high-density and low-density test patterns individually arrive at apposition opposing the toner-adhesion-amount measuring device 8, the measuring device 8 measures the amount of toner adhesion applied on the high-density and low-density test patterns. Outputs of the measuring device 8 are digitized by an A/D converter 46, and then send to the control circuit 45.

The control circuit 45 compares the individual outputs (measurement values) of the toner-adhesion-amount measuring device 8, corresponding to the individual test patterns, with predetermined reference values. Then, according to the result of the comparison, the control circuit 45 performs processing for modifying the grid-bias voltage of the charging unit 2 and the developing bias voltage of the developer unit 4, which are image-forming conditional elements.

In addition, the control circuit 45 performs various other control operations. The control operations include switching control of gradation data from an external apparatus or controller (not shown), gradation data of an independent test pattern specific to the printer, and the gradation data of the patterns for the toner-adhesion-amount measurement; retrieval of the individual outputs of the toner-adhesion-amount measuring device 8 and the toner-density-measuring section 39; control of the amounts of outputs of high voltage power supplies 34, 35, and 44; setting of a target value of the laser-driving current; setting of target values of the toner densities; control for supply of the toner; and compensation operations for gradation characteristics of printer gradation data.

The individual high voltage power supplies 34 and 44 are controlled by output-voltage control signals supplied from the control circuit 45 via individual D/A converters 47 and 48.

The control circuit 45 includes a rewritable memory 61 formed an EEPROM and the like, for not allowing the data to be erased even when the power is turned off; a memory 62 formed of a RAM and the like for storing data; a timer 63 for measuring wait time and the like; and a CPU 64 totally controlling the control circuit 45. The control circuit 45 is connected to an adjustment-rule generating device 200 (described below).

The memory 61 preliminarily stores data of various set values. The data includes, for example, an initial grid bias voltage and an initial developing bias voltage value that correspond to reference gradation characteristics at normal temperature and humidity; test-pattern-gradation data (for the high-density area and the low density area); a predetermined target value for the amount of toner adhesion in the high-density area (the value being used to obtain deviations); a predetermined target value for the amount of toner adhesion in the low-density area (the value being used to obtain deviations); a control standard value for the deviations in the high-density area; a control standard value for the deviations in the low-density area; coefficients representing surface-potential characteristics; a predetermined number of print pages; predetermined passing time; the maximum number of control operations; bias condition values; an abnormality range in the toner-adhesion-amount measuring device 8; and upper-limit and lower-limit values (predetermined ranges) of the amount of reflecting light in areas other than the test pattern areas, the amount of reflecting light in the high-test-pattern area, and the amount of reflecting light in the low-test-pattern area.

The bias condition values are upper-limit and lower-limit values (predetermined range) of the individual grid bias and developing bias, and a tolerance of the differential voltage between the grid bias and developing bias. The aforementioned target value for the high-density test pattern area and the target value for the low-density test pattern area can be modified and inputted, and also, can be displayed on a control panel 49.

The memory 61 functions as either a secondary memory or a long-term memory and stores a dependency table regarding contrast potential modification amounts and a dependency table regarding background potential modification amounts. In addition, the memory 61 stores learning data obtained according to an adaptive control method described later.

The memory 62 functions as either a primary memory or a short-term memory and stores bias values set prior to occurrence of abnormality in the toner-adhesion-amount measuring device 8 (the bias values are stored at setting of a bias modification mode). The memory 62 also comprises a counter for counting control operations, a counter for counting print pages, an abnormality-sensor flag that turns on when abnormality occurs in the toner-adhesion-amount measuring device 8, and a toner-cassette empty flag that turns on when the toner cassette is empty. Furthermore, the memory 62 stores control amount deviations occurred in individual compensation operations and the operation amount corresponding thereto, in a period when an adjustment control system (described below) starts control and converges the deviations into a tolerance.

Figure 4:
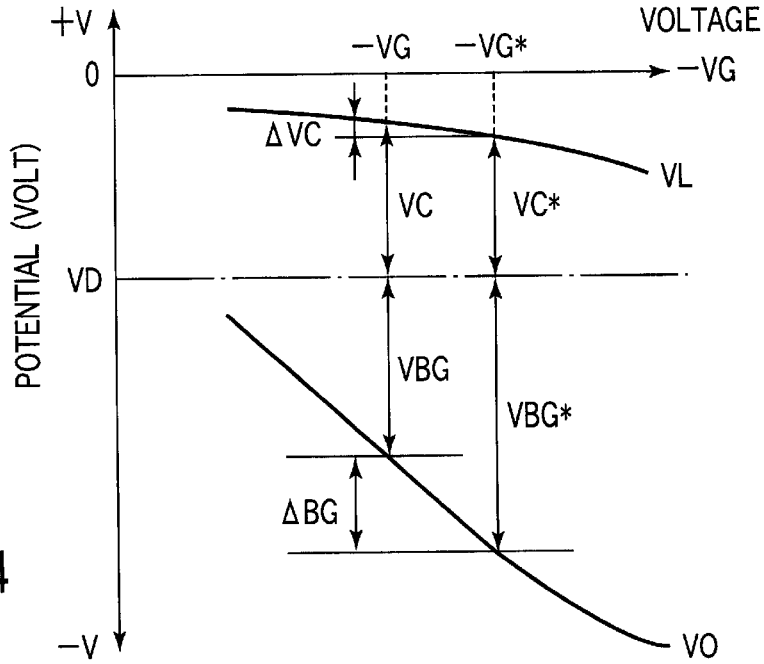
FIG. 4 is a graph showing potentials in unexposed and exposed portions of the photoconductive drum, which are relative to a grid-bias voltage of a charging unit, and a developing bias voltage.

FIG. 4 shows the relationships among an absolute value VG of the bias voltage applied to the grid electrode 33 of the charging unit 2 (which will simply be referred to as a grid-bias voltage); a surface potential VO of the photoconductive drum 1 uniformly charged by the charging unit 2 (which will be referred to as an unexposed-area potential); a surface potential VL of the photoconductive drum 1, which attenuated as a result of entire exposure by the laser exposing unit 13 at a predetermined amount of light (which will be referred to as an exposed-area potential); and a developing bias voltage VD (shown in a single-dotted line). In the present embodiment, the polarity of voltages is negative because of reversal development.

When the grid-bias voltage VG increases, absolute values of the unexposed-area potential VO and the exposed-area potential VL individually decrease. In individual cases where the exposed-area potential VL and the unexposed-area potential VO are linearly approximated to the grid-bias voltage VG, the cases can be expressed as follows:

$$VO(VG)=K1\cdot VG+K2 \quad (1)$$

$$VL(VG)=K3\cdot VG+K4 \quad (2)$$

wherein K1 to K4 individually represent constants; VO, VG, and VL individually represent absolute values; VO(VG) and VL(VG) individually represent the magnitudes of the potentials VO and VL relative to an arbitrary VG.

In this case, the developing bias voltage varies according to relationships among the developing bias voltage VD (absolute value), the exposed-area potential VL, and the unexposed-area potential VO. A contrast potential VC and a background potential VBG are individually defined as follows:

$$VC=VD(VG)-VL(VG) \quad (3)$$

$$VBG=VO(VG)-VD(VG) \quad (4)$$

From the above expressions (1) to (4), the following expressions can be obtained:

$$VG(VC,VBG)=(VC+VBG-K2+K4)/(K1-K3) \quad (5)$$

$$VG(VC,VBG)=K\cdot VG+K2-VBG \quad (6)$$

When the relationships (K1 to K4) among the individual exposed-area potential VL and unexposed-area potential VO and the grid-bias voltage VG are known, the contrast potential VC and the background potential VBG are determined according to the above expressions (5) and (6). This allows the individual grid-bias voltage VG and developing bias voltage VD to be determined to be unique.

Figure 5:
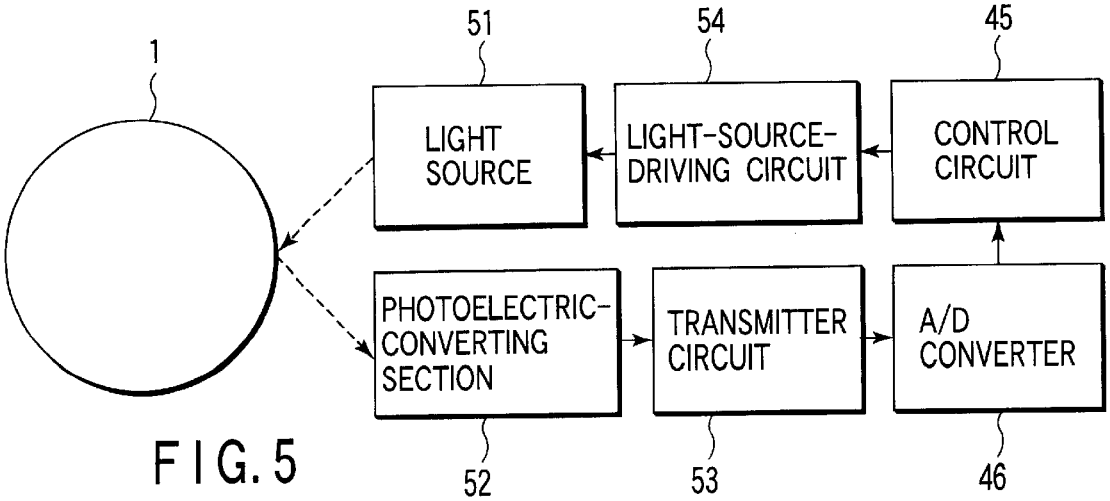
FIG. 5 is a schematic view showing a configuration of the toner-adhesion-amount measuring device.

FIG. 5 shows the toner-adhesion-amount measuring device 8. Light from a light source 51 is incident on the surface of the photoconductive drum 1. The light reflected from either the photoconductive drum 1 or toner adhered thereto in development is converted by a photoelectric-converting section 52 to an electric current according to the amount of the reflecting light. The current is then subjected to current-voltage conversion, and the voltage is transmitted by a transmitter circuit 53 to an A/D converter 46. Then, the voltage is converted to a digital signal, and the digital signal is inputted to the control circuit 45. The light source 51 is driven by a light-source-driving circuit 54 to be a current. The light-source-driving circuit 54 is either controlled by the control circuit 45 so as to turn on or off or controlled by a signal generated for adjusting the amount of a driving current fed to the light source 51.

Then, a description will be given of processing of the adjustment control system and the bias modification mode that adjust the contrast potential and the background potential to those having appropriate values in the color laser printer configured as described above.

Figure 6A:
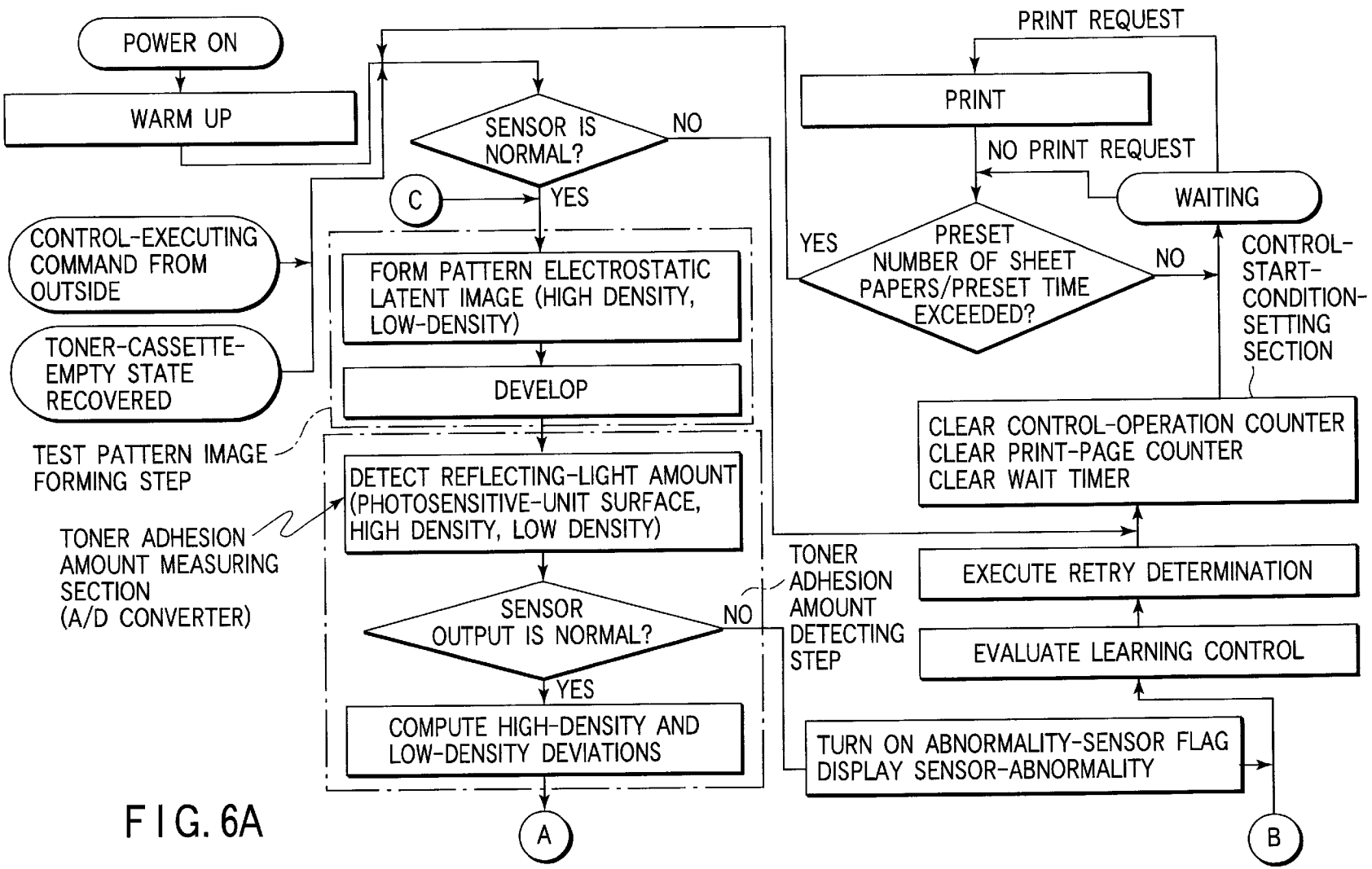
FIGS. 6A and 6B are a flow chart showing operations in a bias modification mode of the color laser printer.
Figure 6B:
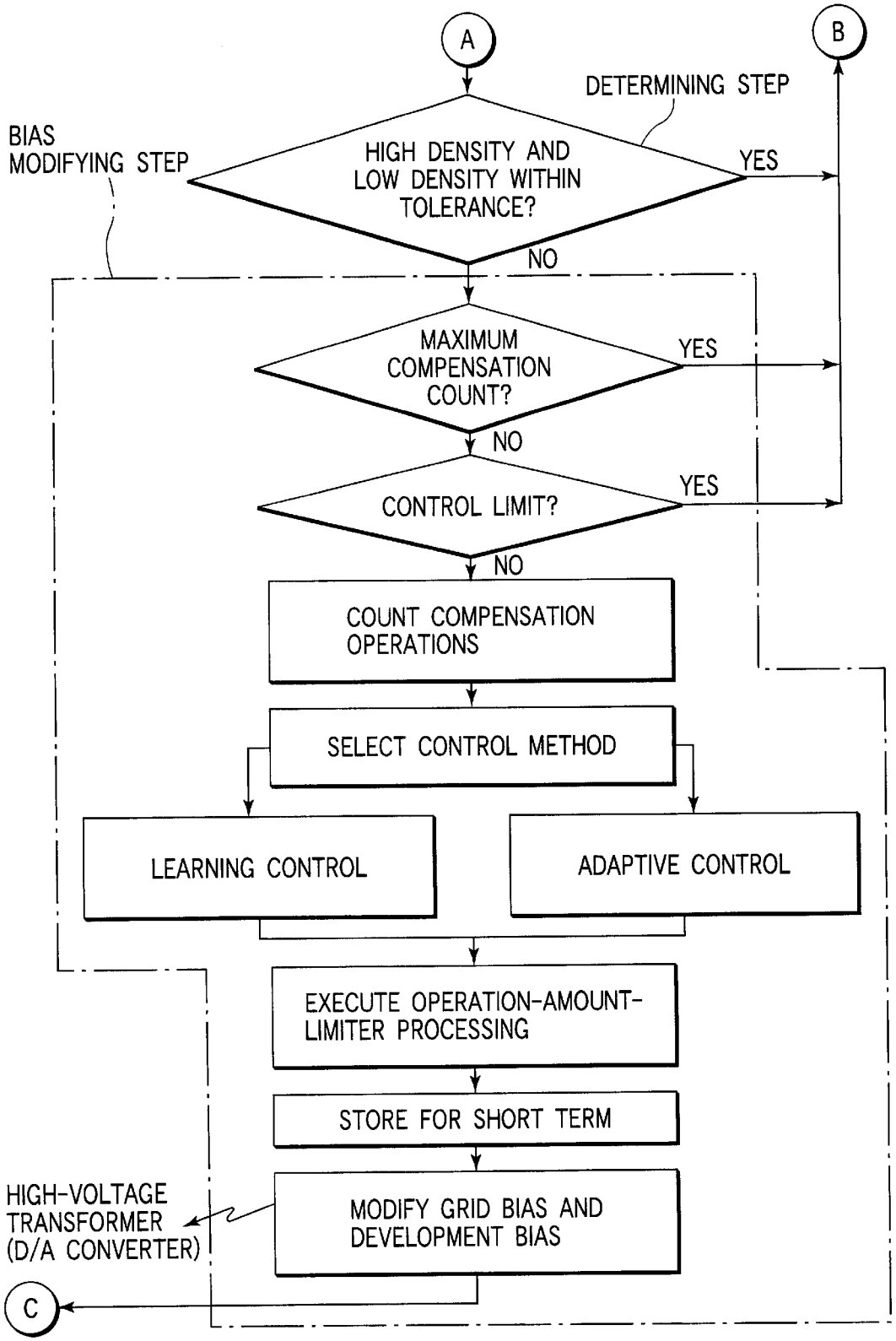

As shown in FIGS. 6A and 6B, the bias modification mode comprises a warming-up step, a test-pattern-image forming step, a toner-adhesion-amount detecting step, a determining step, and a bias modifying step.

First of all, when a power switch (not shown) of the printer is turned on, the CPU 64 in the control circuit 45 in the system performs initializing operations, thereby executing individual initializing operations in a predetermined sequence. A warm-up operation of the fixing unit 27 takes relatively a long time. Either when the warm-up operation is completed or when the temperature thereof becomes a predetermined temperature lower than a predetermined reaching temperature at the completion of the warm-up operation, the system allows image-formation related initializing operations and other operations including a cleaning operation to be performed.

The initializing operations include adjusting operations for the temperature of the photoconductive drum 1 and the system-interior temperature and humidity, a developer-agitating operation, a charging and discharging operations to stabilize characteristics of the photoconductive drum 1, and a cleaning operation for the surface of the photoconductive drum 1. These initializing operations allow setting of substantially the same image-formation environment as in a normal image-formation state.

Upon completion of the warming-up step, the CPU 64 determines whether or not the toner-adhesion-amount measuring device 8 is normal. This determination is made by verification of whether or not the abnormality-sensor flag is turned on as a result of checking performed in the toner-adhesion-amount-detecting step for an output of a sensor. (When the power is turned on, since the flag is reset, the toner-adhesion-amount measuring device 8 is determined to be normal.)

As a result of the above determination, if abnormality is found in the toner-adhesion-amount measuring device 8, the CPU 64 controls a control-start-condition-setting section so as to set control-start conditions including various parameters required for execution of the bias modification mode. The CPU 64 also controls the individual high voltage power supplies 35 and 44 so as to produce voltages corresponding to the initial grid bias voltage value and the initial developing bias voltage value (stored in the memory 61) that are used as the bias conditions corresponding to the reference gradation characteristics at the normal temperature and humidity. Thereby, the CPU 64 controls the individual high voltage power supplies 35 and 44 to enter standby states. Specifically, the initial grid bias voltage value and the initial developing bias voltage value that have been read out from the memory 61 are individually converted by the D/A converters 47 and 48 to output-voltage control signals, and then supplied to the high voltage power supplies 35 and 44, respectively. This way controls the individual high voltage power supplies 35 and 44 to have the aforementioned grid bias voltage value and the developing bias voltage value.

At this time, the CPU 64 resets the individual control-operation counter, print-page counter, and the timer 63 for measuring wait time in the memory 62.

If the toner-adhesion-amount measuring device 8 is determined to be normal, the CPU 64 is turned to the bias modification mode, and processing proceeds to the test-pattern-image forming step. At this step, the CPU 64 controls the memory 62 to store the grid bias voltage value and the developing bias voltage value that are currently set according to the high voltage power supplies 35 and 44 (the values are reference values when the power is turned on, but thereafter, the bias voltage, which has been set until the abnormal state of the measuring device 8 is detected, is used).

After completion of the above-described initializing operations, the test-pattern-image forming step executes charging, developing, cleaning, and discharging operations in the same sequence as in the case of ordinary image-forming operations. Thereby, as shown in FIG. 3, on the photoconductive drum 1, the test-pattern-image forming step forms toner images of the individual high-density and low-density test patterns corresponding to the gradation patterns generated by the pattern generator circuit 38.

At this time, individual values are preset to the grid bias voltage value for the charging unit 2 and the developing bias voltage value for the developer unit 4. These values are used as the condition values corresponding to the reference gradation characteristics at the normal temperature and humidity. Specifically, the CPU 64 reads out the output-voltage-control signals that individually represent the initial grid bias voltage value and the initial developing bias voltage value from the memory 61. Then, the CPU 64 feeds the signals to the high voltage power supplies 35 and 44 via the D/A converters 47 and 48, thereby allowing the aforementioned operations to be executed.

The size of each of the two individual test patterns has a predetermined width with the center of the image forming area in the axial direction of the photoconductive drum 1, and a predetermined length in the rotational direction of the photoconductive drum 1. These two test patterns are formed on the photoconductive drum 1 so as to be apart from each other at a predetermined distance in the rotational direction thereof. The predetermined width corresponds to the position of the toner-adhesion-amount measuring device 8 in the axial direction of the photoconductive drum 1. The width is predetermined to be minimum so as to prevent influences of, for example, an electrophotography-specific edge effect, to be included within the size of a detection-spot. The predetermined length is set to be minimum so that influences of the edge-effect and the like and sensor-response characteristics are not included in detection results.

Subsequently, in the toner-adhesion-amount detecting step, the toner-adhesion-amount measuring device 8 detects the amounts of reflecting light from the two individual test patterns, in synchronization with timing when the test patterns reach those positions which face the measuring device 8. In addition, the toner-adhesion-amount measuring device 8 detects the amount of reflecting light from an area of the photoconductive drum 1 which is not developed with a predetermined timing, that is, the amount of reflecting light from an unexposed area.

The amounts of reflecting light, which have been detected by the toner-adhesion-amount measuring device 8, i.e., the amount of reflecting-light from the unexposed area, the amount of reflecting light from the low-density area, and the amount of reflecting light from the high-density area, are fed to the CPU 64 as sensor outputs via the A/D converter 46. The CPU 64 compares each of the individual amounts of reflecting light ,i.e., the amount of reflecting light from the area other than the test-pattern areas, the amount of reflecting light from the high-density area, and the amount of reflecting light from the low-density area, which have been provided from the A/D converter 46 with upper-limit and lower-limit values (predetermined range) read out from the memory 61.

As a result of the above comparison, if the CPU 64 detects an output value that is out of the predetermined range, it determines the output of the toner-adhesion-amount measuring device 8 to be abnormal. Subsequently, the CPU 64 turns on the abnormality-sensor flag in the memory 62 and allows a display section of the control panel 49 to display that the output value of the toner-adhesion-amount measuring device 8 is abnormal. Concurrently, the CPU 64 reads out bias values that are in a state before the system enters the bias modification mode in this particular case and controls the individual high voltage power supplies 35 and 44 by using output-voltage control signals representing the read out bias-voltage values. Thereafter, the system enters a standby state.

If the output value of the toner-adhesion-amount measuring device 8 is determined to be normal, the CPU 64 computes the amount of toner adhesion in a low-density pattern area and the amount of toner adhesion in a high-density pattern area as control amounts. The computation is carried out on the basis of predetermined functions regarding optical reflectance relative to a low-density pattern area and a high-density pattern area that are defined with reference to the amount of reflecting light from the unexposed area, which has been fed from the A/D converter 46.

In addition, the CPU 64 compares the amount of toner adhesion in the high-density pattern area and the amount of toner adhesion in the low-density pattern area, which are computed as described above, with predetermined target values stored in the memory 61. Thereby, the CPU 64 computes a control amount deviation in the high-density pattern area and a control amount deviation in the low-density pattern area.

Subsequently, processing enters the determining step. The CPU 64 determines whether or not the control amount deviation in the high-density pattern area and the control amount deviation in the low-density pattern area, which have been computed as described above, are individually within predetermined tolerances stored in the memory 61. If either the control amount deviation in the high-density pattern area or the control amount deviation in the low-density pattern area is determined to be within the corresponding tolerance, the CPU 64 first executes a learning-control evaluating step and a retry-determining step. Then, the CPU 64 resets the control-operation counter, the print-page counter, and the timer 63 for measuring wait time. Then, the printer enters a standby state (that is, a state where the printer is ready to start printing upon print request).

If at least one of the control amount deviations is out of the tolerance, processing proceeds to the bias-modifying step. The bias-modifying step adjusts the control amount deviation in the high-density pattern area and the control amount deviation in the low-density pattern area. To perform the adjustment, the bias-modifying step obtains a grid bias voltage value and a developing bias voltage value that must be modified, and then modifies the values.

Specifically, in the bias-modifying step, the CPU 64 first determines whether or not a compensation count reaches a predetermined maximum compensation count. If the compensation count is determined to have reached the predetermined maximum compensation count, processing bypasses the subsequent adjustment controls and proceeds to a learning-control-evaluating step. If the determination result is negative, processing proceeds to an operation-limit determination.

The operation-limit determination references information indicating whether or not control-limiter processing (described below) has caused the system to be in a state of an operation limit, and then determines whether or not the system is in the state of the operation limit, that is, whether the operation amount cannot be compensated for any more. If the system is determined to be in the state of the operation limit, processing bypasses the compensation operation and proceeds to the learning-control-evaluating step. If the system is determined to be not in the state of the operation limit, the compensation count is incremented.

Subsequently, processing proceeds to a step of selecting control-method, and the CPU 64 selects one of the adaptive control method and a learning-control method as the adjustment-controlling method for the bias voltage. Then, according to a selected control method, the CPU 64 performs adjustment control until the bias voltage is converged into the predetermined range.

Hereinbelow, a description will be given of the adaptive control method and the learning-control method.

Figure 7:
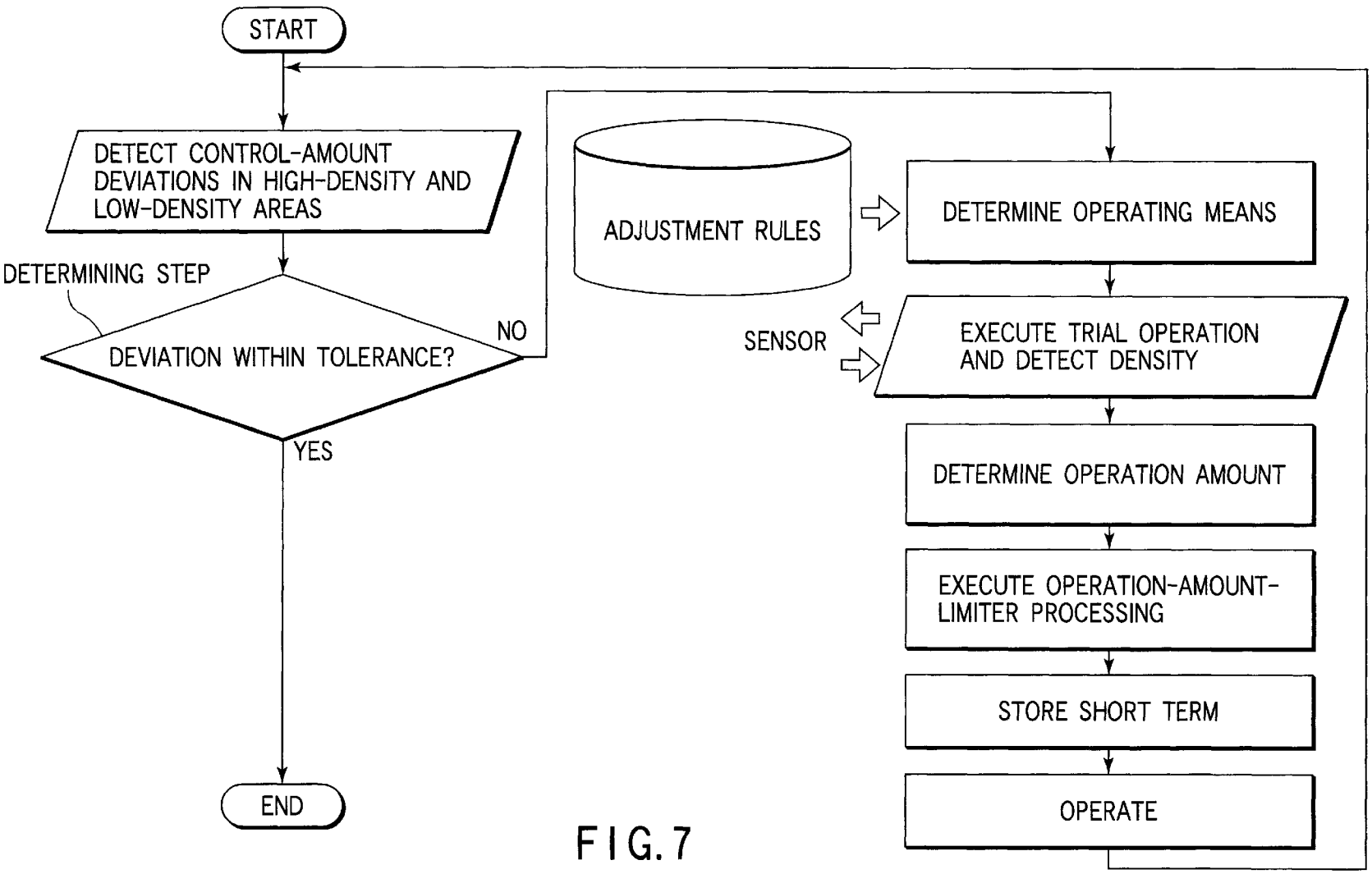
FIG. 7 is a flow chart of an adaptive-control method in an adjustment control system of the color laser printer.

In the adaptive control method, as shown in FIG. 7, according to adjustment rules (described below) stored in the memory 61, the CPU 64 first selects and determines an operating means that must be carried out corresponding to a control amount deviation, i.e., an objective control amount deviation, intended to be compensated for. In specific, the CPU 64 selects and determines one of a contrast potential and a background potential.

Subsequently, the CPU 64 performs a trial operation for the selected operating means by using a predetermined operation amount; specifically, the CPU 64 adjusts the grid bias voltage and the developing bias voltage in accordance with the expressions (5) and (6) so as to modify the selected contrast or background potential by a predetermined amount. Thereby, the CPU 64 detects the sensitivity of the objective control amount deviation in relation to the operation amount; that is, the CPU 64 detects an actual variation range of the objective control amount deviation. Subsequently, according to the detected sensitivity, the CPU 64 computes and determines the amount of operation of the operating means for reducing the objective control amount deviation.

Then, according to operation-amount-limiter processing, the CPU 64 determines whether or not the operation amount, which has been determined as mentioned above, is within predetermined upper-limit and lower-limit values of the operation amount. If the operation amount is equal to or larger than the predetermined upper-limit value, the upper-limit value is adapted; and if the operation amount is equal to or smaller than the predetermined lower-limit value, the lower-limit value is adapted. After the operation-amount-limiter processing, the CPU 64 controls the memory 62, serving as a short-term memory, to store the detected objective control amount deviation and the operation amount, which has been determined to compensate therefor. Then, according to the determined operation amount, the CPU 64 operates the selected operating means, thereby implementing the adjustment.

The control-amount deviation detection, the determining step, the operation-amount determination, and the adjustment operation are repeated until the above-described objective control amount deviation is controlled so as to be within the tolerance. When all the control amount deviations are converged into the tolerance, that is, when the result of the determining step is "YES", the adaptive control is completed.

Hereinbelow, a description will be given of the adjustment rules. Potential-variation effects that influence to the control amount deviation in the high-density area and the control amount deviation in the low-density area, are not always independent of each other and have the interdependent relationship. Therefore, determination of the individual bias values from the individual deviations causes contradiction.

Figure 8:
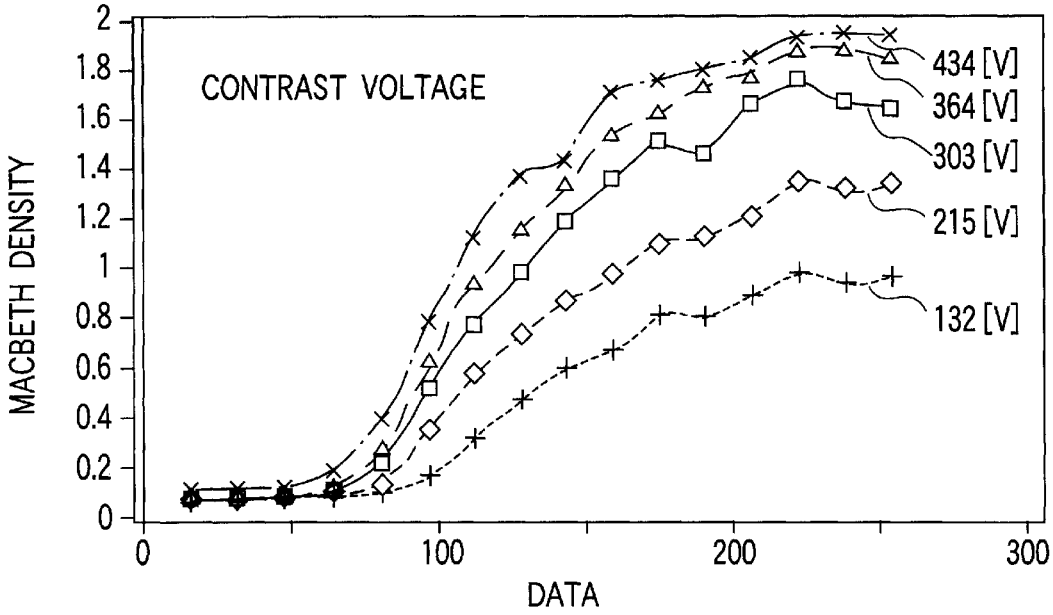
FIG. 8 is a characteristics graph showing variation in gradation characteristics when a contrast potential of the color laser printer is changed.
Figure 9:
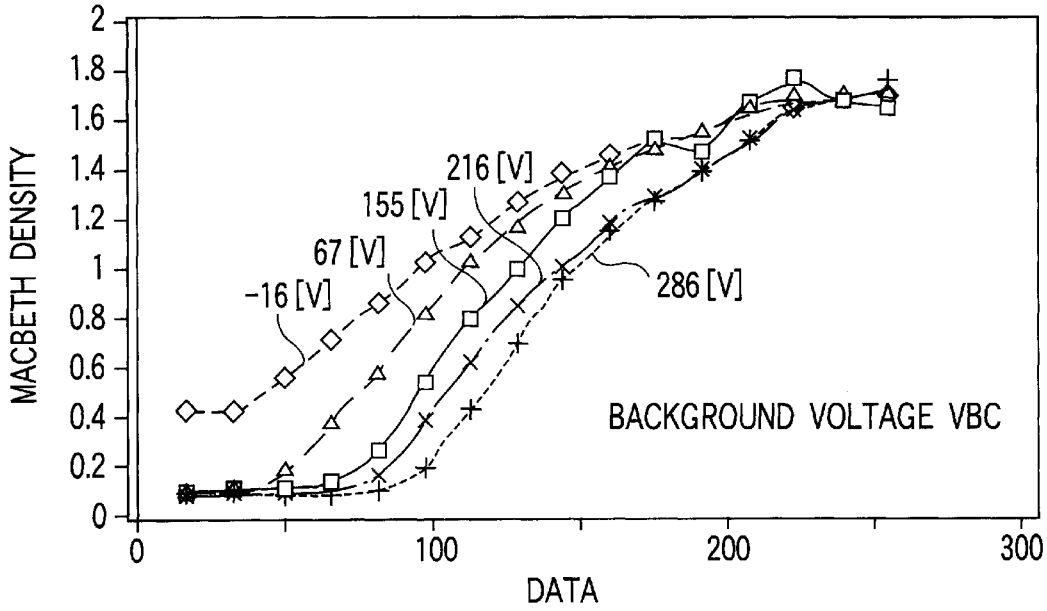
FIG. 9 is a characteristics graph showing variation in gradation characteristics when a background potential of the color laser printer is changed.

FIG. 8 is a graph showing the variation in the gradation characteristics in a case where the contrast potential is modified. In the graph, the horizontal axis represents gradation data, and the vertical axis represents output-image densities. Similarly, FIG. 9 is a graph showing the variation in the gradation characteristics in a case where the background potential is modified. The contrast potential and the background potential work for the high-density area and the low-density area, respectively; and working methods of the individual voltages have the interdependent relationship. The influence of the variation in the contrast potential increases proportional to the increase in the density; however, the influence of the variation in the background potential increases as the density decreases.

The control circuit 45 in the color laser printer comprises the adjustment-rule generating device 200, as described above. When performing an adjustment operation for one of the contrast potential and the background potential, the adjustment-rule generating device 200 generates a suitable adjustment rule according to the dependence relationship with control amounts for other adjustment areas.

Figures 10, 11A, 11B, 12:
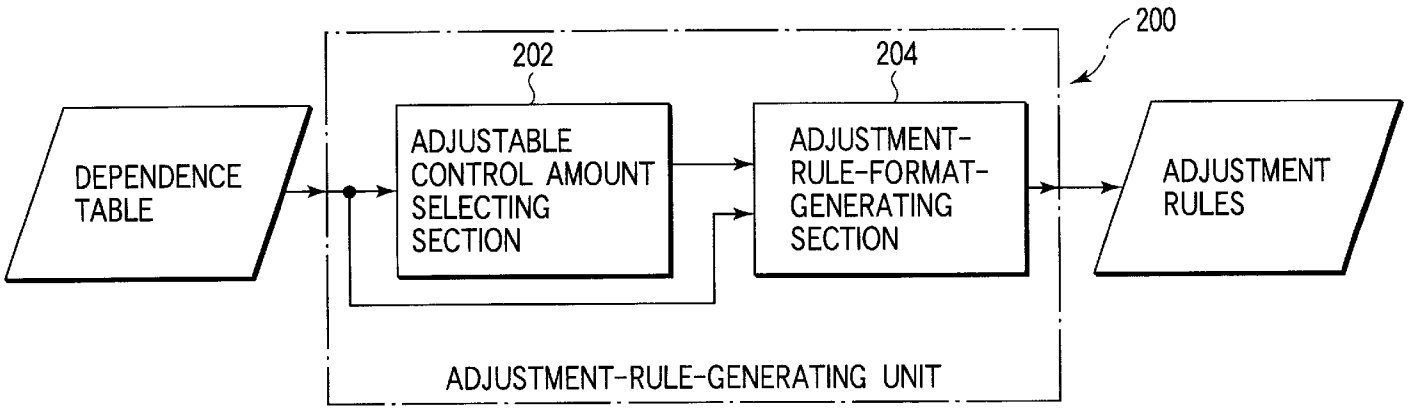
FIG. 10 is a schematic view showing an outline of an adjustment-rule generating device in the adjustment control system.
FIGS. 11A and 11B are views showing definitions of control amounts and operation amounts in the adjustment control system.
FIG. 12 is a dependence table showing the dependence relationships between the control amounts and operation amounts.

As shown in FIG. 10, the adjustment-rule generating device 200 comprises an adjustable-control-amount selecting section 202 and an adjustment-rule-format-generating section 204. These sections 202 and 204 generates adjustment rules according to a dependence table indicating relationships with control amounts for other biases, which depend on the control amount for one of the grid bias and the developing bias. Specifically, the adjustable-control-amount selecting section 202 selects an adjustable control amount according to dependence-table information that has been inputted. The adjustment-rule-format-generating section 204 uses a result of the selection performed by the adjustable-control-amount selecting section 202 and the dependence-table information. Thereby, the adjustment-rule-format-generating section 204 converts the relationship between the control amount and the operation amount to a format of the adjustment rule.

Subsequently, according to the adjustment rule generated by the adjustment-rule generating device 200, the toner-density detected by the toner-density measuring device, and other conditions, the most appropriate adjustment area, that is, the most appropriate operating means is selected and determined.

FIG. 11A shows definitions of operation amounts of a contrast potential and a background potential. The subscript of a control amount deviation "e" represents a control-amount number, and the corresponding expression defines the number. The definitions are as follows:

$e1=\Delta QH$ ($=QH-QHT$): high-density-area deviation $e2=\Delta QL$ ($=QL-QLT$): low-density-area deviation In these definitions, QH represents a toner-adhesion-amount value in a high-density area, and QHT represents a target value thereof; and similarly, QL represents a toner-adhesion-amount value in a low-density area, and QLT represents a target value thereof.

FIG. 11B shows definitions regarding a contrast potential and operation amounts. The subscript of an operation amount "a" represents an operation-amount number, and defines a label indicating a corresponding actual operating means. The definitions are as follows:

a1=ΔVC (contrast potential-modification amount)

a2=ΔVBG (bias-voltage-modification amount)

FIG. 12 shows a dependence table indicating the dependence relationships between the control amounts and the operation amounts. The dependence table is created by inputting the following three types of data:

1. Data representing the number of the operation amounts (the number of the operation amounts and the number of the control amounts are assumed to be the same);
2. Data representing the relationships in the influence given by the individual operation amounts on the individual control amounts; and
3. Data representing whether each of the operation amounts relatively varies the control amount in the same direction or in a different direction.

In specific, in the dependence table, e1, e2, a1, and a2 individually represent the control amounts and the operation amounts that are shown in FIGS. 11A and 11B. Also, in the dependence table, a "○" mark is shown for the control amount that is sensitive, i.e., that is influenced, when one of the operation amounts is operated; while a "X" mark is shown for the control amount that is not influenced when one of the operation amounts is operated. Conversely, in a case where the "○" marks are shown for a certain control amount ei relative to a plurality of the operation amounts e, the case indicates that the control amount has the dependence relationships with the plurality of the operation amounts. In consideration of adjustability, it is preferable that the control amount uniquely corresponds to one of the operation amounts; that is, it is preferable that they are independent of each other.

Also, in the "O/G" line field ("O" stands for offset, and "G" stands for gradient) indicates dependence characteristics of two or more control amounts that depend on a certain operation amount. In specific, basically, in a case of two control-amount variation patterns relative to basically one operation-amount variation, the case where they vary in the same direction is defined to be the offset (variation pattern "1"), and the case where they vary in directions differing from each other is defined to be gradient (variation pattern "1"). Therefore, in a case where they are independent of each other, since one operation amount is determined for one operating means, the case is determined to be gradient.

The above-described dependence table shows a case where e1 (high-density-area deviation) for a2 (background potential) can be determined not to vary, and it indicates that e1 can be adjusted by a1. In the rule generation, it is understood that the control can be directed to the convergence by a rule wherein an offset and a control amount that relatively greater dependence are given priority for adjustment, and e2 is adjusted by a2 after e1 is adjusted by a1.

As described above, the adjustment rules define combinations that converge the dependence relationships (independence and dependence) of the control amounts with the operation-amount variables according to a qualitative knowledge. In this case, unless feedback causes extreme deviations between the knowledge regarding the dependence relationships and reality, ordinary deviations are finally converged into the tolerance. Thus, the arrangement with the adjustment rules realizes the adjustment control system that is capable of easily converging the deviations into the tolerance, thereby avoiding processing for collection of adjustment rule regarding all the operation-amount variables for all the control-amount spaces. In addition, the system is arranged without the qualitative knowledge being given, but is instead arranged on a basis of using the sensitivity obtained in actual operation of a selected operating means. Therefore, the system does not cause a state that increases difficulty in convergence of deviations in relation to the dependence on the other operating means and control-object characteristics with respect to the difference between products and aged deteriorations.

Referring to FIGS. 13A to 13F, a description will be given of an example case in which the adaptive-control method is used to perform adjustment and conclusion for control amount deviations.

The individual figures show control-amount-deviation spaces. In each of the spaces, the horizontal axis and the vertical axis are represented by e1 and e2, respectively; the cross point of the cl central axes that are perpendicular to each other represents deviation "0" (zero); and an internal rectangular area B surrounding the central point represents an allowable deviation ranges (tolerance) for each the deviations.

In this example, the rule generation allows the following rules to be obtained:

Adjustment rule 1: When either e1 or e2 is out of the tolerance, the system is to operate an operating means 1 (offset operating means). The system is to notice greater one of the deviations, and is to determine an operation amount from sensitivity.

Adjustment rule 2: When one of the deviations is out of the tolerance, the system is to operate an operating means 2 (gradient operating means). The system is to notice greater one of the deviations, and is to determine an operation amount from sensitivity.

Figure 13A:
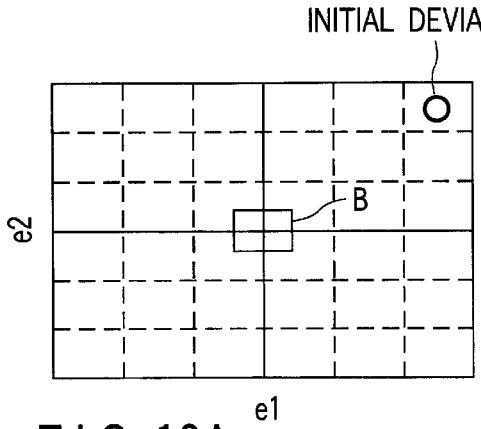
FIGS. 13A to 13F are deviation-space views individually showing example convergence stages of a control amount deviation in the adaptive-control method.
Figure 13B:
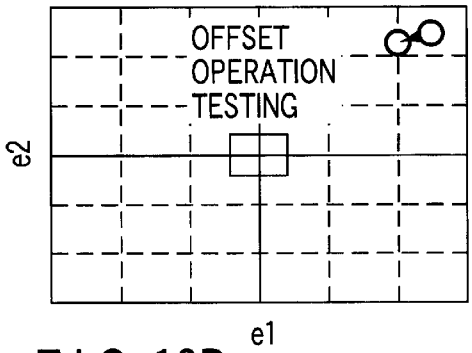

As shown in FIG. 13A, first of all, when either the deviation e1 or the deviation e2 of an initial deviation is out of the tolerance, the system performs the following operations according to the adjustment rule. The system selects the operating means 1 (offset operating means). Then, since the sensitivity is not yet verified, the system performs a trial operation by using a predetermined operation amount, and thereafter, the system detects deviations again. Then, from the initial deviation, the system detects the amount of variation in the deviation e1, i.e., an objective control amount deviation, and the sensitivity of the deviation e1, as shown in FIG. 13B.

Figure 13C:
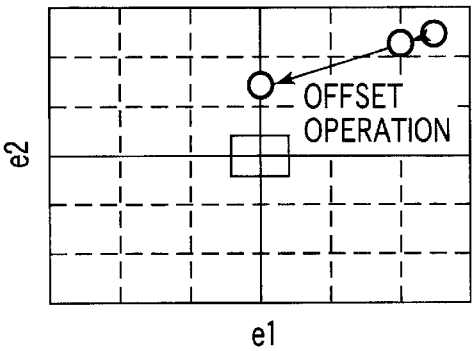

Subsequently, the system computes the deviation e1 obtained so as to produce an operation amount that allows adjustment of the deviation e1 to "0". Then, according to the produced operation amount, the system operates the operating means 1 again. As a result of these operations, as shown in FIG. 13C, the deviation e1 varies to be within the tolerance, and the deviation e2 varies to be out of the tolerance.

Figure 13D:
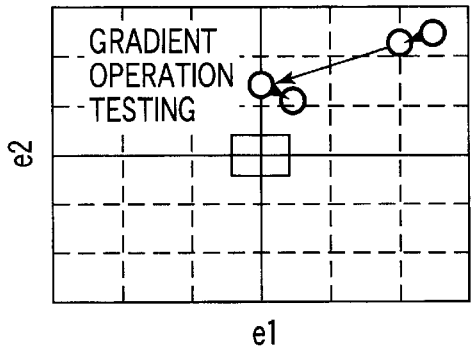
Figure 13E:
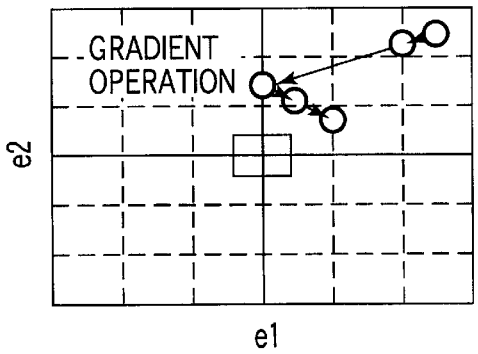

Subsequently, according to the adjustment rule, the system selects the operating means 2 (gradient operating means). Then, since the sensitivity is not yet verified, the system performs a trial operation by using a predetermined operation amount, and thereafter, the system detects deviations again. Subsequently, as shown in FIG. 13D, the system obtains the sensitivity of the deviation e2, that is, the objective control amount deviation; and from the obtained sensitivity, the system determines an operation amount that allows adjustment of the deviation e2 to "0". Then, the system operates the operating means 2 again according to the obtained operation amount. As a result of these operations, as shown in FIG. 13E, either the deviation e1 or the deviation e2 varies to be out of the tolerance. However, the individual deviations approach "0"; that is, the individual deviations are on their ways where they are converged into the tolerance.

Figure 13F:
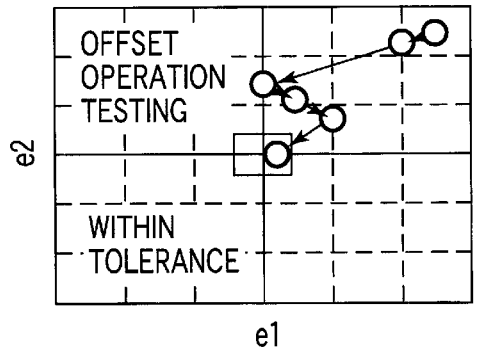

Subsequently, according to the above-described adjustment rules, the system repeats the above operations, that is, the detections, the determination, the operating-means selection, the trial operation, the sensitivity detection, and the operation-amount determination. Thereby, as shown in FIG. 13F, both the deviation e1 and the deviation e2 are converged into the tolerance, and the adaptive control is completed. Upon determination of the convergence of the control amount deviations at the determining step, all the control amount deviations and the operation amounts determined corresponding to the control amounts are read out from the memory 62 and are then stored in the memory 61 as successful instances at the individual adjustment operations performed in the period when the system starts control and converges the deviations.

Thus, in the adaptive-control method, only the information representing the existence of the dependence characteristics of the two operation amounts on the two corresponding control amounts is given as the aforementioned qualitative knowledge. For other factors of the qualitative knowledge, adjustment rules are generated according to predetermined algorithms, and sensitivities are checked and determined on an operation basis for actual adjustment objects. This allows the provision of the adjustment control system that can comply with requirements for, needless to say, reduction in manpower for system development, and also for the difference between the produces and aged deteriorations.

The adjustment control system of the present embodiment is configured to selectively execute the adaptive-control and the learning-control methods. Hereinbelow, the learning-control method is described.

As described above, when the control amount deviations are adjusted into the tolerance by the adaptive control, the operation amounts corresponding to the control amounts are recorded in the memory 61 as successful instances and stored as a learning data. In the subsequent adjustment-control operations, when control amount deviations similar to the successful instances obtained by learning are detected, the learning-control method is executed to adjust operation amounts by using learning data.

Figure 14:
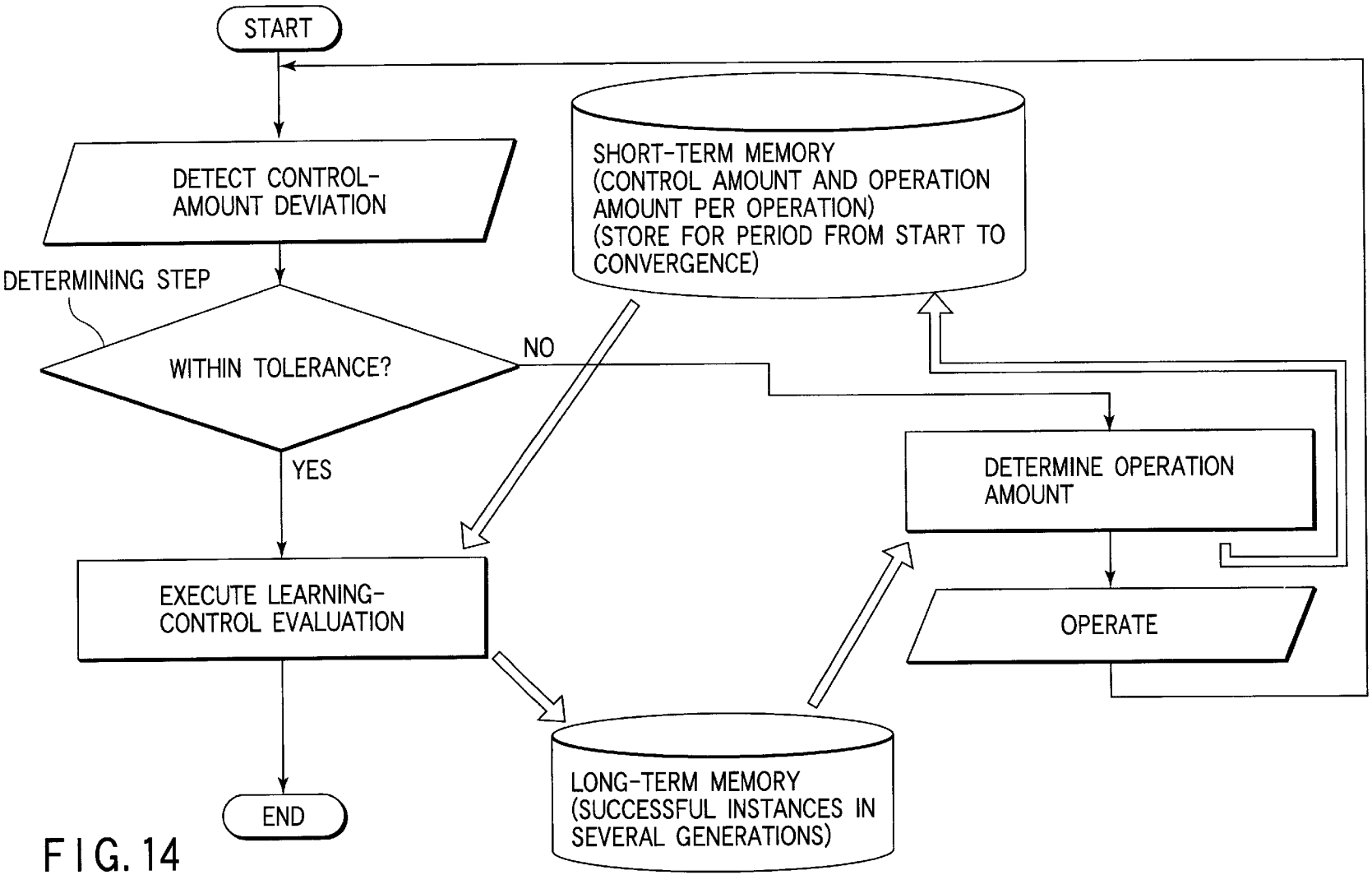
FIG. 14 is a flow chart of a learning-control method in the adjustment control system of the color laser printer.

As shown in FIG. 14, according to the learning-control method, if a detected control amount deviation is determined at a determining step to be out of a tolerance (determined to be "NO"), the CPU 64 in the control circuit 45 determines whether or not a leaning data (the operating amount stored as a conventional successful instance) corresponding to the computed control amount is stored in the memory 61. If a successful instance is determined to be stored therein, the method reads all operation amounts of the operating means, which correspond, to the aforementioned control amount and uses them. Then, according to the operation amounts that have been read out, all of the operating means are operated for adjustment. If no successful instance corresponding to the control amount deviation is stored in the memory 61, the operation amount is determined according to the adaptive-control method.

Hereinbelow, by comparing FIGS. 15A to 16B with each other, a description will be given regarding cases where the same initial control amount deviation is controlled and adjusted by using the individual adaptive-control method and learning-control method.

Figures 15A, 15B:
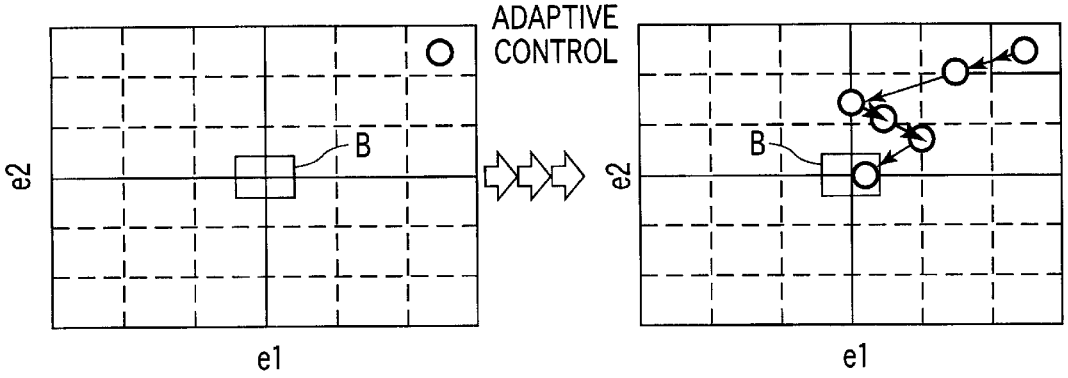
FIGS. 15A to 15B are deviation-space views individually showing an initial control amount deviation and convergence stages thereof in the adaptive-control method.
Figures 16A, 16B:
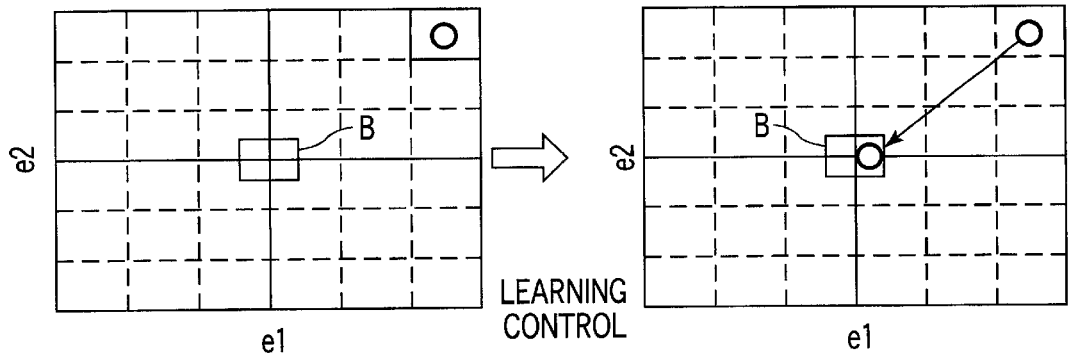
FIGS. 16A to 16B are deviation-space views individually showing an initial control amount deviation and convergence stages thereof in the learning-control method.

If no successful instance corresponding to the control amount deviation is stored, the adaptive-control method is selected. As described above, in the adaptive-control method, a control amount deviation is gradually converged from the state of an initial deviation as shown in FIG. 15A, and is controlled to be in the tolerance B as shown in FIG. 15B. On the other hand, in the learning-control method, the operating means is operated according to the operation amount corresponding to the control amount deviation stored as learning data. In this case, one operation allows a control amount deviation in a state of an initial deviation as shown in FIG. 16A to be converged into the tolerance B as shown in FIG. 16B, if the printer is in the same condition as that in the successful instance.

According to a feedback control method as the adaptive-control method that ensures convergence and a control pattern of the learning-control method, the operation amount can be selectively determined. This allows the provision of the adjustment control system that realizes reduction in manpower for system-design, securement of the convergence characteristics, and reduction in the number of control operations.

However, the described adjustment control system that selectively executes the adaptive-control method and the learning-control method causes an undesirable case. When an abnormality occurs, or when an aged deterioration occurs in characteristics of a color laser printer subjected to the adjustment, for example, contrast potential characteristics and background potential characteristics, operation amounts corresponding to control amount deviations stored as the learning data are left as inappropriate data. Although adjustment operations may be performed using such operation amounts, the operations may have difficulty in convergence of control amount deviations or may cause overshoot. In such cases, if the learning-control operation steps are subsequently executed, similar problems such as the difficulty in convergence of the control amount deviations and overshoot will occur.

Figure 17A:
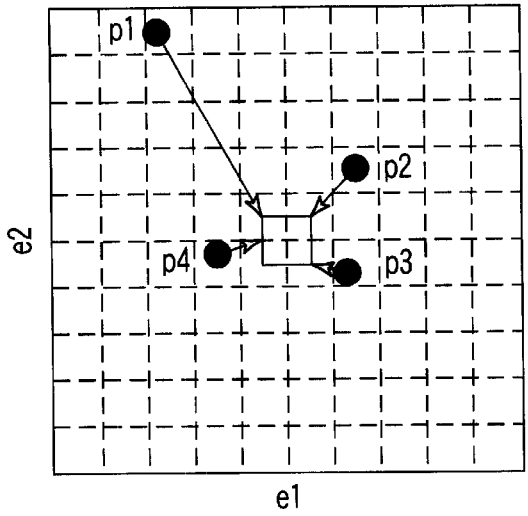
FIG. 17A is a deviation-space view showing a stage where multiple control amount deviations are individually converged according to the aforementioned learning-control method.

For example, as shown in FIG. 17A, when learning data stored in the memory 61 is appropriate, adjustment operations are performed using individual operation amounts corresponding to various control amount deviations. In this case, each of the individual control amount deviations can be converged by one adjustment operation into the tolerance B.

Figure 17B:
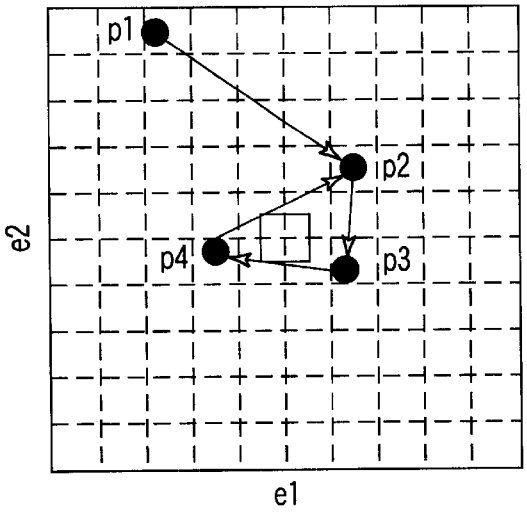
FIG. 17B is a deviation-space view showing a state where a control amount deviation is not converged and is caused to oscillate according to the learning-control method.

However, when learning data is inappropriate because of variation in characteristics of the color laser printer, as shown in FIG. 17B, even though one adjustment operation is performed according to the operation amount obtained by learning, there occur cases where control amount deviation is not converged into the tolerance B, and the control amount deviation is regarded as a deviation other than those stored as the learning data. Alternatively, there occurs a case where the control amount deviation repeatedly oscillates around the tolerance B and may not be converged into the tolerance B within a predetermined number of adjustment operations being performed.

Figure 17C:
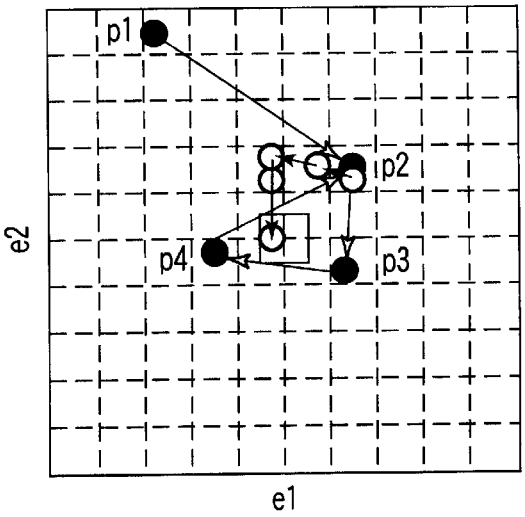
FIG. 17C is a deviation-space view showing a case where a control amount deviation is converged by switching the learning-control method to the adaptive-control method.

According to the adjustment control system of the present embodiment, in such a case where the convergence of the control amount deviation by the learning-control method is difficult, the method is switched to the adaptive-control method, and the feedback control is thereby performed, as shown in FIG. 17C. Thereby, the convergence of the control amount deviation can be ensured, and in addition, the inappropriate learning data is either unemployed or deleted.

Figure 18:
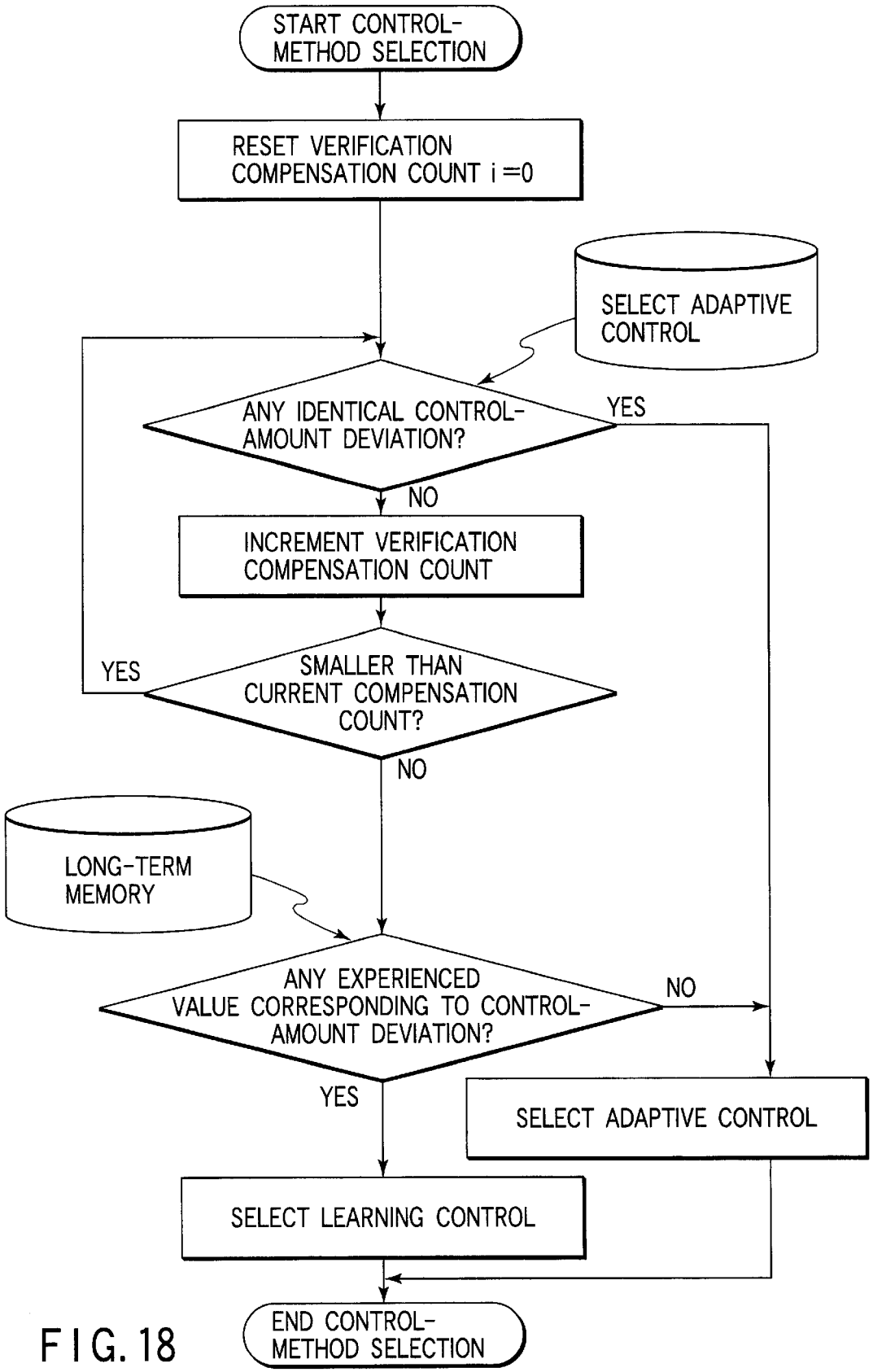
FIG. 18 is a flow chart showing a process of selecting control-method in the adjustment control system.

Specifically, as shown in FIG. 18, in the step of selecting control-method, the CPU 64 in the control circuit 45 first resets a verification compensation count to the initial state of i=0 to determine whether or not the short-term memory contains a control amount deviation matching a computed control amount deviation. Thereafter, the CPU 64 sequentially compares individual compensation-count-recording fields to the control amount deviation to determine whether or not matching control-amount-deviation data is stored.

If no matching control-amount-deviation data is determined to exist in the compensation-count fields before the current compensation-count-recording field, the CPU 64 determines whether or not learning data matching the computed control amount deviation is already stored in the long-term memory. If matching learning data is determined to be stored, the CPU 64 selects the learning-control method, that is, the method for determining an operation amount according to the stored learning data. On the other hand, if no matching learning data is determined to have been stored in the long-term memory, that is, either if the computed control amount deviation is determined to have never been used before (not experienced) or if no corresponding successful instance is determined to be stored, the CPU 64 selects the adaptive-control as the control method.

As a result of comparison to control amount deviations stored in the short-term memory, if a control amount deviation matching the current control amount deviation is determined to have already been stored, that is, if the same control amount deviation has reoccurred in a period when the system starts the control and converges a deviation into the tolerance, the CPU 64 disregards the learning data stored in the long-term memory and selects the adaptive-control method for the subsequent operations.

Figure 19:
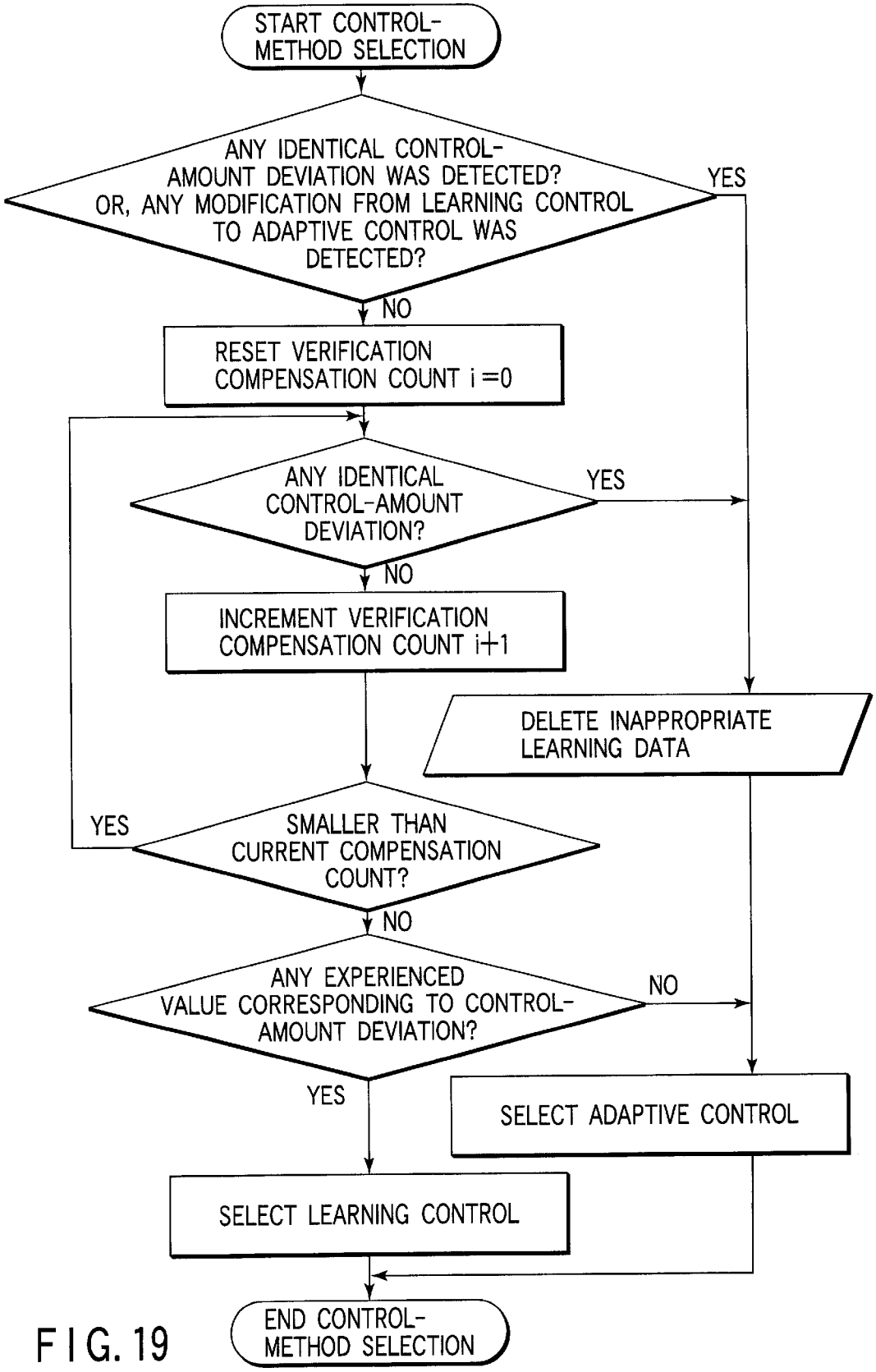
FIG. 19 is a flow chart showing another process of selecting control-method in the adjustment control system.

In the above, the following alternative arrangement may be made. As shown in FIG. 19, in the control-method-selecting step, either suppose a control amount deviation that matches a current computed control amount deviation is stored in the short-term memory or suppose the control method is determined to have been switched from the learning-control method to the adaptive-control method. In this case, the alternative arrangement may be such that the CPU 64 stores the aforementioned instance in a period when the system starts the control and converges the deviation into the tolerance, and the subsequent control-method-selecting steps inhibit selection of the learning-control method and instead allow the adaptive-control method to always be selected until the adjustment-controlling method is completed.

In the above case, the CPU 64 concurrently determines the operation amount corresponding to the aforementioned matching control amount deviation to be inappropriate; therefore, it deletes them from the long-term memory.

Figure 20:
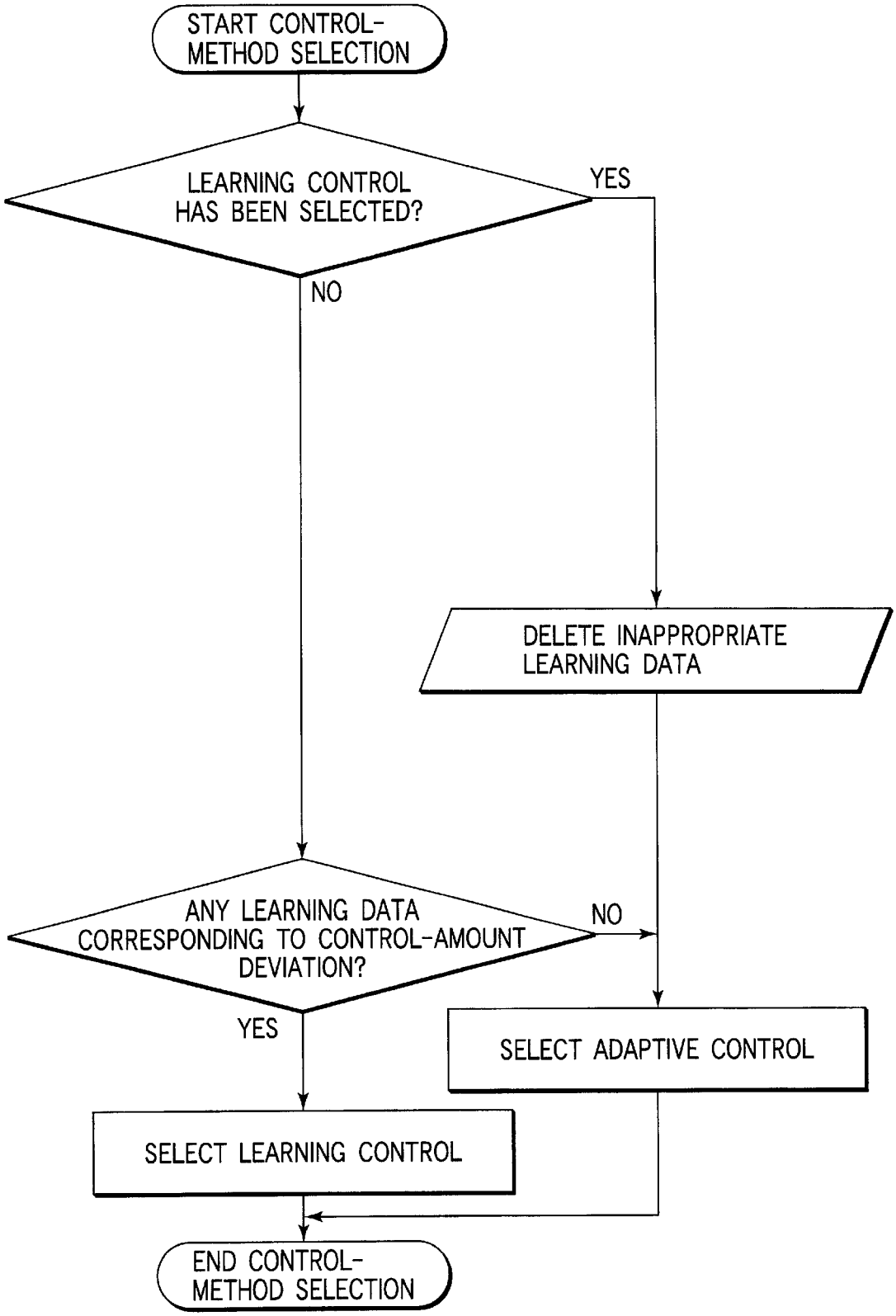
FIG. 20 is a flow chart showing a modification of the process of selecting control-method in the adjustment control system.

According to a modified example of the control-method-selecting step, as shown in FIG. 20, when the CPU 64 selects the learning-control method in the selecting step in a period when the system starts the control and converges a deviation into a tolerance, the CPU 64 stores the instance; and after the subsequent control-method-selecting step is started, the CPU 64 determines whether or not the learning-control method has been selected. In a case where the determination result is "YES", the case signifies that although the learning-control method was executed for a control amount deviation in the previous adjustment-control operation, the control amount deviation was not converged into the tolerance by one compensating operation. That is, it signifies that since the characteristics of an adjustment object varied, the learning data was inappropriate. For this reason, if the determination result is "YES", the CPU 64 inhibits selection of the learning-control method in the subsequent operations until the adjustment control is completed, and selects the adaptive-control method. Concurrently, the CPU 64 determines the learning data employed in the previous adjustment-control operation to be defective and therefore deletes the learning data from the long-term memory.

If the aforementioned determination result is "NO", the CPU 64 determines whether or not corresponding learning data is stored in the long-term memory. If the determination result is "YES", the CPU 64 selects the learning-control method. If the determination result is "NO", the CPU 64 selects the adaptive-control method.

Figure 21:
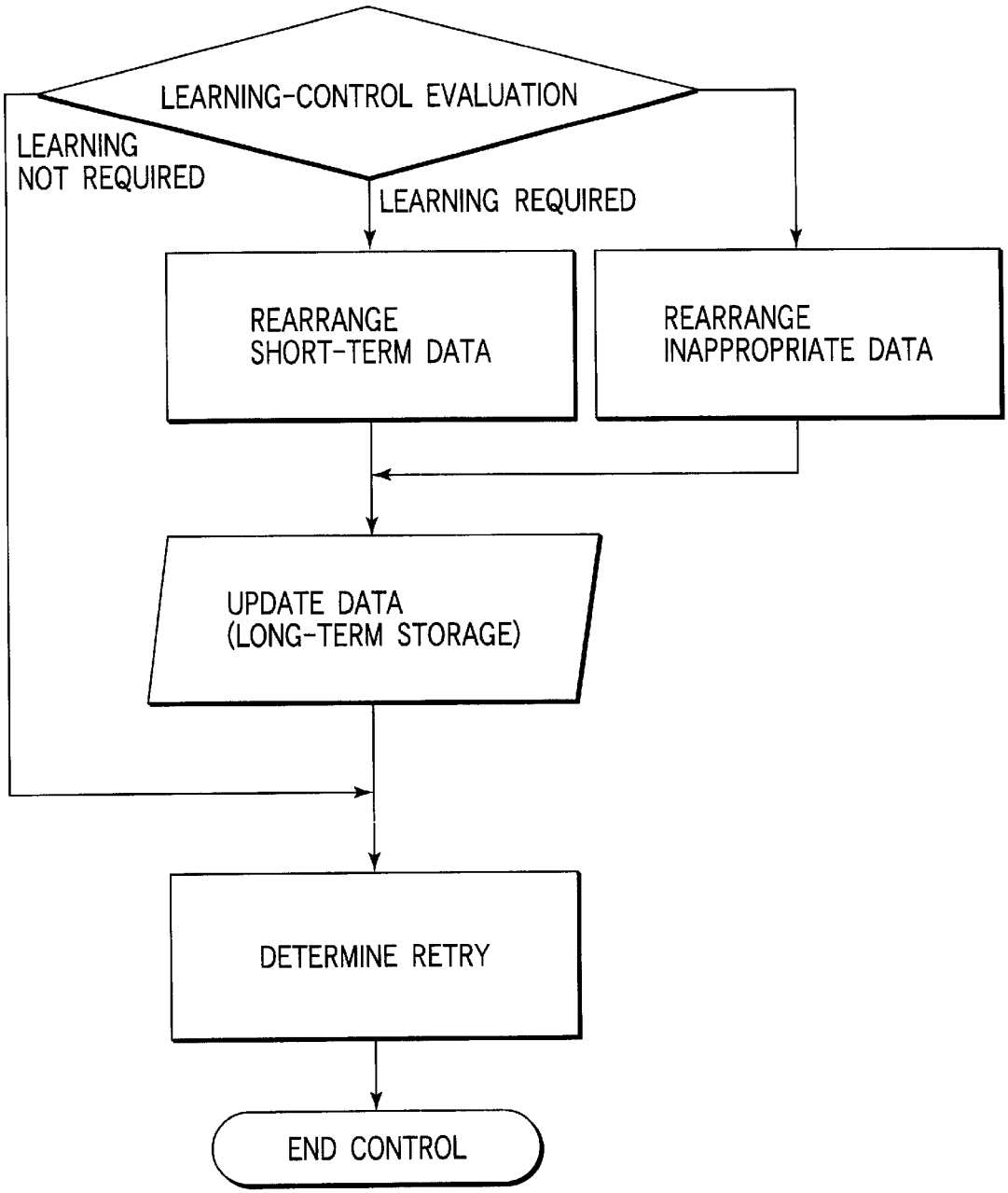
FIG. 21 is a flow chart showing a learning-control-evaluating step in the adjustment control system.
Figure 22:
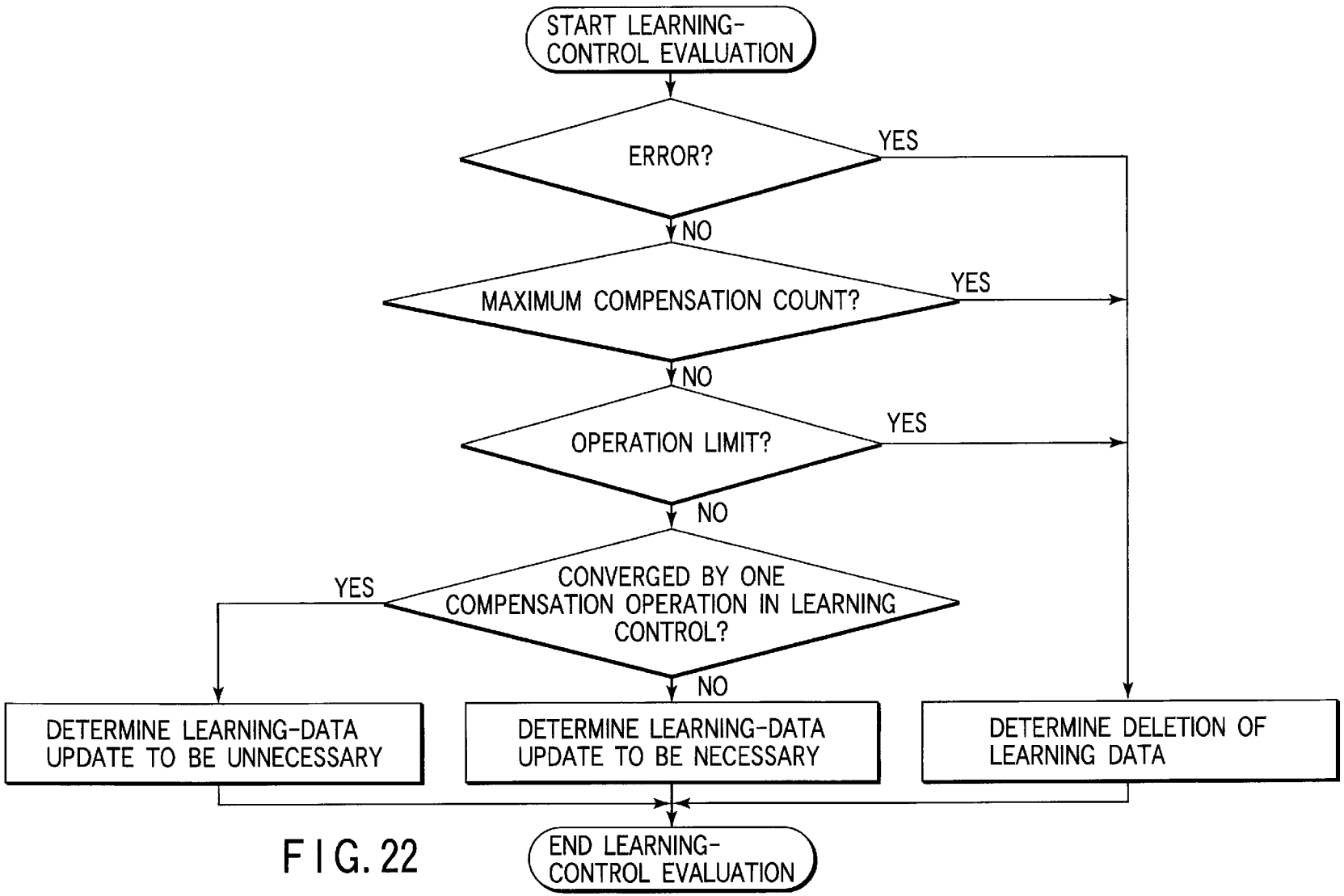
FIG. 22 is a detailed flow chart of the learning-control-evaluating step in the adjustment control system.

As shown in FIGS. 6, 21, and 22, suppose the determining step determines a control amount deviation to be within the tolerance. Specifically, suppose a control amount deviation is converged into the tolerance, suppose an error such as abnormality in the toner-adhesion-amount measuring device 8 occurs, suppose the compensating-operating count reaches the maximum compensation count, suppose the operation-limit determination is made, or suppose the operation-limit determination is made. In this case, processing proceeds to the learning-control-evaluating step, and the evaluating step performs determination for updating and deletion of the learning data according to the individual states.

If the learning-control evaluation determines the learning data to be updated, that is, as shown in FIG. 21, if the adjustment control is normally completed, short-term data consisting of the control amount deviations for individual compensation operations and the operation amounts corresponding thereto, which are stored in the short-term memory, is rearranged in a short-term-data-rearranging section. Then, the learning-control-evaluating step obtains the total amount of operations executed during the respective operations for compensating the control amount deviations (including the starting control) until the control is completed. On the other hand, if the learning-control-evaluating step determines the learning data to be deleted since the learning data is determined to be inappropriate due to a change in characteristics of an adjustment object, the total amount of operations corresponding to control amount deviations for individual compensation operations (stored in the short-term memory) is replaced by clearing values ("0") in a defective-data-disposing section.

A data-modifying section either rewrites or deletes the total amount of operations corresponding to the control amount deviations for the individual compensation operations (which are either rearranged in the short-term-data-rearranging section or disposed in the defective-data-disposing section) in the learning data stored in the long-term memory. Thereby, the data-modifying section updates the learning data.

Moreover, as shown in FIG. 22, suppose execution of the learning-control method results in one of control-termination conditions; that is, suppose processing results in being affirmative for one of the determination conditions for occurrence of an error, the maximum compensation count, and the operation limit for the operation amount. In this case, the CPU 64 determines the learning data to be deleted and deletes all the learning data stored in the long-term memory. On the other hand, in the execution of the learning-control method, if the control amount deviation is converged into the tolerance by one compensation operation, the CPU 64 determines learning-data update to be unnecessary and allows the learning data the long-term memory to remain unchanged. In contract, if the control amount deviation is not converged into the tolerance by one compensation operation, the CPU 64 determines learning-data update to be necessary.

Figure 23:
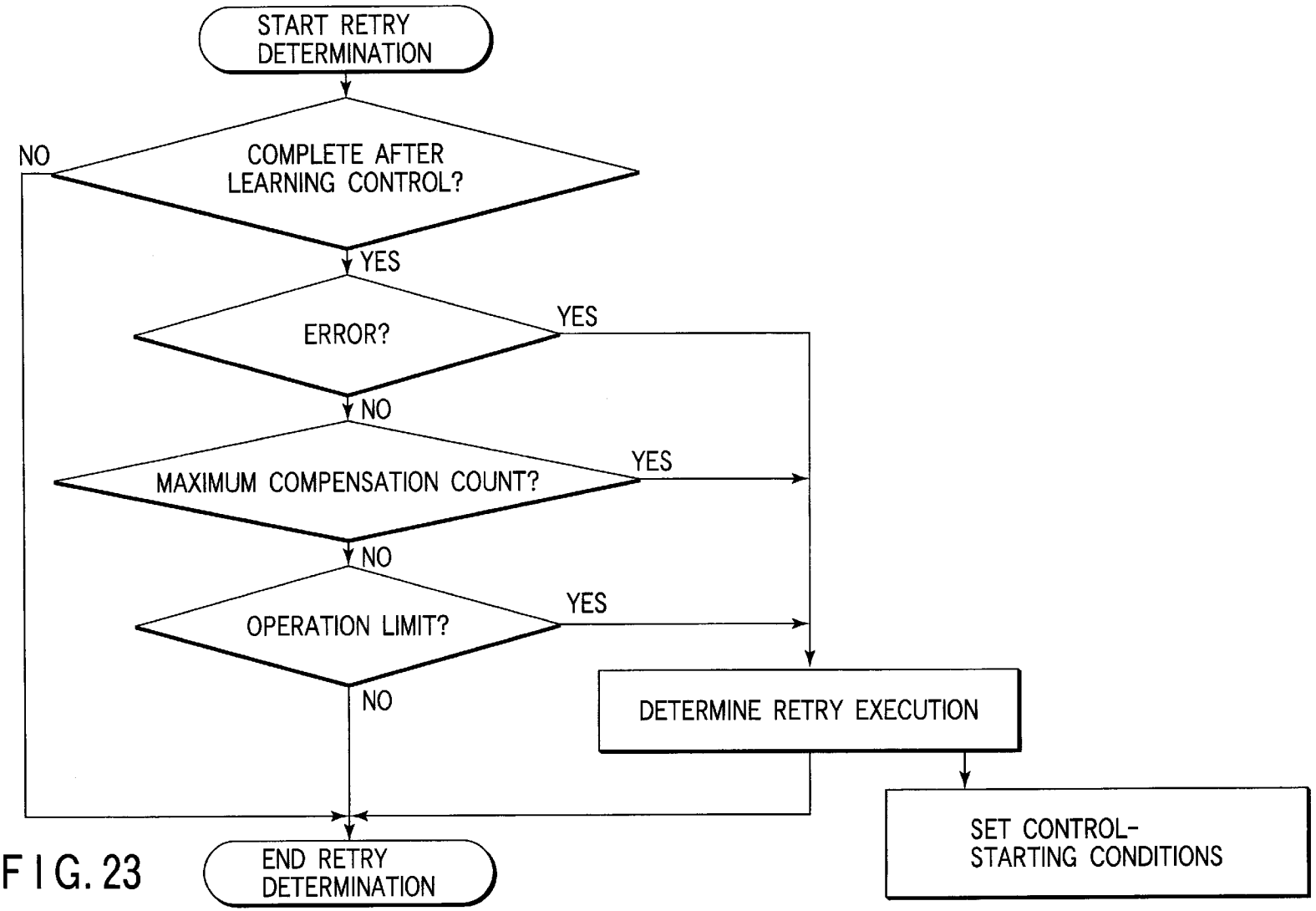
FIG. 23 is a flow chart showing a retry-determination step in the adjustment control system.

In a retry-determination step, as shown in FIG. 23, a control-cancellation condition is redefined with a predetermined condition, and the step determines whether or not the adjustment control needs to be reexecuted. Specifically, in the adjustment control, as a result of the execution of the learning-control method, in an event where the control amount deviation is not converged into the tolerance, and if the event is determined to satisfy one of control-termination conditions, the CPU 64 determines the retry-execution to be performed. In the retry-execution, the CPU 64 redefines the control-start conditions and selects the adaptive-control method, thereby reexecuting the adjustment control.

In the color laser printer comprising the adjustment control system configured as described above that ensures the convergence of deviations, no failure in the convergence occurs. Also, since the adjustment control system learns the successful instances in the object-adjustment system, the color laser printer is given capability of complying with the requirements for control-system characteristics with respect to the difference between the products and aged deteriorations. Regarding the efficiency of converging processing, since individual system devices autonomously comply with relevant requirements, it is sufficient to ensure only essential convergence by performing the feedback control; and the manpower for data collection, testing, and the like for optimization can be significantly reduced.

Furthermore, the manpower for designing control devices (particularly for tuning) can be reduced; and concurrently, a control-system configuration capable of autonomously complying with requirements for the difference between the products and long-term aged deteriorations can be realized. Still furthermore, the described embodiment allows reduction in the number of convergence operations to be implemented in the following manner. A control method such as the adaptive-control method that ensures the convergence is used together with the learning-control method. According to the combination, in an inexperienced state, the sensitivity is successively checked, the operation amount is thereby determined, convergence operations are thereby performed, and cases where the convergence operations are completed are learned as successfully experienced instances. In a case similar to the above, the knowledge obtained by the learning is used in the operations. Thus, the number of operations can be reduced.

Still furthermore, in a case where the learning-control method is executed, either when the convergence of a control amount deviation is difficult because of a variation in characteristics of an adjustment object or when overshoot is caused, the control method is switched to the adaptive-control method, thereby allowing the convergence characteristics of the control to be ensured. Still furthermore, by deletion of learning data that is determined to be inappropriate, recurrence of defects such as overshoot can be prevented, thereby allowing reliability to be improved.

The present invention is not restricted to the described embodiments, and it may be modified in various ways within the scope of the invention. For example, the invention can be applied not only to the color laser printer, but also to various other image forming apparatuses, such as analog copying machines and digital copying machines. Furthermore, the adjustment control system of the present invention can be applied not only to the adjustment of the contrast potential and the background potential, but also to the adjustment of other devices and apparatuses, such as an optical unit in an exposure device in image forming apparatuses.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalents.

What is claimed is:

1. An adjustment control system for an image forming apparatus, comprising:

detecting means for detecting individual control amounts;

deviation computing means for computing a plurality of control amount deviations according to the control amounts detected by the detecting means and a predetermined target value;

deciding means for deciding whether or not the individual control amount deviations are within a predetermined tolerance;

operation amount determining means for determining an operation amount for compensating each of the plurality of control amount deviations when at least one of the control amount deviations is decided by the deciding means to be out of the predetermined tolerance;

a plurality of operating means for compensating the control amounts by performing operation by the operation amount determined; and a processing step controlling section for executing adjustment control that repeats the detection of the control amounts, the decision, the determination of the operation amounts, and the operation of the operating means until the control amount deviations computed are converged into the predetermined tolerance, wherein the operation amount determining means comprises:

an adaptive control section for executing adaptive control, including operation selecting means for selecting the operating means for adjusting objective control amount deviations that are out of the predetermined tolerance according to a preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations;

first storing means for storing control amount deviations and the operation amounts corresponding thereto on a basis of the detection and operation in a period when adjustment of the objective control amount deviations is started and the objective control amount deviations are adjusted to be within the tolerance;

second storing means for computing the sum of the operation amounts which correspond to the control amounts in each compensation operation and stored in the first storing means and for storing the sum of the operation amounts as learning data when all the control amount deviations are adjusted to be within the tolerance;

a learning control section comprising second operation amount computing means for determining the operation amount for the operating means according to the learning data stored in the second storing means and for executing a learning control method;

determining means for determining whether or not learning data corresponding to the control amount deviations is stored in the second storing means;

first control-method selecting means for determining the operation amount by selecting the adaptive control section when no corresponding learning data is determined by the determining means to exist and for determining the operation amount by selecting the learning control section when corresponding learning data is determined by the determining means to exist; and switching means for switching to adaptive control by the adaptive control section when a control amount deviation identical to the control amount deviation stored in the first storing means is computed by the deviation computing means during the execution of the learning control by the learning control section.

2. An adjustment control system according to claim 1, wherein the operation amount determining means comprises: second determining means for determining whether or not a control amount deviation matching the control amount deviation computed by the deviation computing means is stored in the first storing means; and second control method selecting means for selecting the adaptive control section so as to determine the operation amount if a matching control amount deviation is determined by the second determining means to exist, and for allowing the first control-method selecting means to select one of the adaptive control section and the learning control section if no matching control amount deviation is detected to exist.

3. An adjustment control system according to claim 2, wherein, if a matching control amount deviation is detected by the second determining means to exist, the operation amount determining means determines the adaptive control by means of the adaptive control section until the control amount deviation computed is adjusted into the predetermined tolerance.

4. An adjustment control system according to claim 3, wherein the second control method selecting means comprises: determination-result storing means for storing data representing matching of control amount deviations if a matching control amount deviation is determined by the second determining means to exist; and selecting means for selecting the adaptive control section if data representing matching of control amount deviations is stored in the determination-result storing means.

5. An adjustment control system according to claim 3, wherein, the second control method selecting means comprises: switching storing means for storing data representing switching of the control method when a control method is switched from the learning control by the learning control section to the adaptive control by the adaptive control section; and selecting means for selecting the adaptive control section when data representing switching of the control method is stored in the switching storing means.

6. An adjustment control system according to claim 1, wherein, the operation amount determining means comprises learning-data deleting means for deleting learning data used in the learning control when the learning control is switched by the switching means to the adaptive control by the adaptive control section.

7. An adjustment control system according to claim 6, wherein the operation amount determining means comprises: second determining means for determining whether or not a control amount deviation matching the control amount deviation computed by the deviation computing means is stored in the first storing means; and second control method selecting means for determining the adaptive control section to determine the operation amount if a matching control amount deviation is determined by the second determining means to exist and for allowing the first control-method selecting means to select one of the adaptive control section and the learning control section if no matching control amount deviation is detected to exist; and if a matching control amount deviation is determined by the second determining means to exist, the learning-data deleting means deletes all the learning data that is stored in the second storing means and that corresponds to the individual control amount deviations stored in the first storing means.

8. An adjustment control system for an image forming apparatus, comprising:

detecting means for detecting individual control amounts;

deviation computing means for computing a plurality of control amount deviations according to the control amounts detected by the detecting means and a predetermined target value;

deciding means for deciding whether or not the individual control amount deviations are within a predetermined tolerance;

operation amount determining means for determining an operation amount for compensating each of the plurality of control amount deviations when at least one of the control amount deviations is determined by the first detecting means to be out of the predetermined tolerance;

a plurality of operating means for compensating the control amounts by performing operation by the operation amount determined; and a processing step controlling section for executing adjustment control that repeats the detection of the control amounts, the decision, the determination of the operation amounts, and the operation of the operating means until the control amount deviations computed are converged into the predetermined tolerance, wherein the operation amount determining means comprises:

an adaptive control section for executing adaptive control, including operation selecting means for selecting the operating means for adjusting objective control amount deviations that are out of the predetermined tolerance according to a preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations;

first storing means for storing control amount deviations and the operation amounts corresponding thereto on a basis of the detection and operation in a period when adjustment of the objective control amount deviations is started and the objective control amount deviations are adjusted to be within the tolerance;

second storing means for computing the sum of the operation amounts which correspond to the control amounts in each compensation operation and stored in the first storing means and for storing the sum of the operation amounts as learning data when all the control amount deviations are adjusted to be within the tolerance;

a learning control section comprising second operation amount computing means for determining the operation amount for the operating means according to the learning data stored in the second storing means and for executing a learning control method;

determining means for determining whether or not learning data corresponding to the control amount deviations is stored in the second storing means;

first control-method selecting means for determining the operation amount by selecting the adaptive control section when no corresponding learning data is determined by the determining means to exist and for determining the operation amount by selecting the learning control section when corresponding learning data is determined by the determining means to exist; and switching means for switching to the adaptive control by the adaptive control section when a control amount deviation is not converged into the predetermined tolerance as a result of the execution of the learning control by the learning control section.

9. An adjustment control system according to claim 8, wherein the operation amount determining means comprises: method selection storing means for storing data representing that the learning control was executed according to the learning control section;

second determining means for determining whether or not data representing execution of the learning control is stored in the method selection storing means; and second control method selecting means for determining the operation amount by selecting the adaptive control section if data representing the execution of the learning control is detected by the second determining means to be stored and for allowing the control method selecting means to select one of the adaptive control section and the learning control section if data representing the execution of the learning control is not stored.

10. An adjustment control system according to claim 9, further comprising initial condition setting means for setting initial conditions and for clearing the data stored in the method selection storing means when the adjustment control is started.

11. An adjustment control system according to claim 8, wherein, the operation amount determining means comprises learning-data deleting means for deleting learning data used in the learning control when the learning control is switched by the switching means to the adaptive control by the adaptive control section.

12. An adjustment control system according to claim 11, wherein the operation amount determining means comprises:

method selection storing means for storing data representing that the learning control was executed by the learning control section, and second control method selecting means for determining the operation amount by selecting the adaptive control section if data representing the execution of the learning control is detected by the second determining means to be stored and for allowing the control method selecting means to select one of the adaptive control section and the learning control section if data representing the execution of the learning control is not stored; and if data representing the execution of the learning control is detected by the second determining means to be stored, the learning-data deleting means deletes all the learning data that is stored in the second storing means and that corresponds to the individual control amount deviations stored in the first storing means.

13. An adjustment control system according to claim 12, further comprising initial condition setting means for setting initial conditions when the adjustment control is started and also for clearing the data stored in the method selection storing means.

14. An adjustment control system for an image forming apparatus, comprising:

detecting means for detecting individual control amounts;

deviation computing means for computing a plurality of control amount deviations according to the control amounts detected by the detecting means and a predetermined target value;

deciding means for deciding whether or not the individual control amount deviations are within a predetermined tolerance;

operation amount determining means for determining an operation amount for compensating each of the plurality of control amount deviations when at least one of the control amount deviations is determined by the first detecting means to be out of the predetermined tolerance;

a plurality of operating means for compensating the control amounts by performing operation by the operation amount determined; and a processing step controlling section for executing adjustment control that repeats the detection of the control amounts, the determination, the determination of the operation amounts, and the operation of the operating means until the control amount deviations computed are converged into the predetermined tolerance, wherein the operation amount determining means comprises:

an adaptive control section for executing adaptive control, including operation selecting means for selecting the operating means for adjusting objective control amount deviations that are out of the predetermined tolerance according to a preliminarily provided adjustment rule, sensitivity detecting means for performing trial operations by a predetermined amount for the operating means selected and for thereby detecting the sensitivities of the control amount deviations which vary depending on the operation amount of the operating means, and first operation amount computing means for determining the operation amount according to the sensitivities detected for the operating means for reducing the objective control amount deviations;

first storing means for storing control amount deviations and the operation amounts corresponding thereto on a basis of the detection and operation in a period when adjustment of the objective control amount deviations is started and the objective control amount deviations are adjusted to be within the tolerance;

second storing means for computing the sum of the operation amounts which correspond to the control amounts in each compensation operation and stored in the first storing means and for storing the sum of the operation amounts as learning data when all the control amount deviations are adjusted to be within the tolerance;

a learning control section comprising second operation amount computing means for determining the operation amount for the operating means according to the learning data stored in the second storing means and for executing a learning control method;

determining means for determining whether or not learning data corresponding to the control amount deviations is stored in the second storing means;

control method selecting means for determining the operation amount by selecting the adaptive control section when no corresponding learning data is determined by the determining means to exist and for determining the operation amount by selecting the learning control section when corresponding learning data is determined by the determining means to exist; and learning-data deleting means for deleting learning data used in the learning control when the control amount deviations satisfy predetermined adjustment control completion conditions before the control amount deviations are converged into the predetermined tolerance as a result of execution of the learning control by the learning control section, the adjustment control completion conditions including a conditional case where the operation amount is out of a predetermined limit value and a conditional case where the number of operations of the operating means in the adjustment control reaches a predetermined maximum number of control operations.

15. An adjustment control system according to claim 14, wherein the operation amount determining means comprises: method selection storing means for storing data representing that the learning control was executed by the learning control section, completion-state storing means for storing data representing that the control amount deviation reached the adjustment control completion conditions, and second determining means for determining whether or not data representing the execution of the learning control is stored in the completion-state storing means; and the learning-data deleting means deletes all the learning data that is stored in the second storing means if data representing the execution of the learning control and data representing the completion state are detected by the second determining means to be stored.

16. An adjustment control system according to claim 12, further comprising: initial condition setting means for setting initial conditions and for clearing the data stored in the method selection storing means when the adjustment control is started, and retry means for allowing the initial condition setting means to clear data representing the initial conditions and the data in the method selection storing means and for allowing the adaptive control section to re-execute the adaptive control.

* * * * *